US005526628A

United States Patent [19]

Knudson

[11] Patent Number: 5,526,628

[45] Date of Patent: Jun. 18, 1996

[54] BUILDING AND METHOD AND APPARATUS FOR MAKING, PANEL ASSEMBLIES AND CONNECTING APPARATUS

[76] Inventor: Gary A. Knudson, 17356 W. 57th Ave., Golden, Colo. 80401

[21] Appl. No.: 209,310

[22] Filed: Mar. 14, 1994

Related U.S. Application Data

[63] Continuation-in-part of Ser. No. 810,218, Dec. 19, 1991, abandoned.

[51] Int. Cl.[6] ..... F04B 1/32

[52] U.S. Cl. ..... 52/528; 52/537; 52/588.1; 52/745.05; 52/748.1

[58] Field of Search ..... 52/520, 521, 588.1, 52/528, 529, 530, 630, 639, 549, 86, 745.05, 545, 534–537, 748.1

[56] References Cited

U.S. PATENT DOCUMENTS

| | | | |
|---|---|---|---|
| Re. 33,566 | 4/1991 | Heckelsberg | 52/544 |
| 586,658 | 7/1897 | Gross . | |
| 1,198,764 | 9/1916 | Pruden | 52/588.1 |
| 3,290,845 | 12/1966 | Snyder | 52/545 |
| 3,398,491 | 8/1968 | Babcock | 52/90.1 |
| 3,511,011 | 5/1970 | Straus | 52/545 |
| 3,555,758 | 1/1971 | Schroter | 52/309.2 X |
| 3,557,511 | 1/1971 | Curran . | |
| 3,568,388 | 3/1971 | Flachbarth et al. | 52/588.1 |
| 3,842,647 | 10/1974 | Knudson | 29/155 X |
| 3,889,437 | 6/1975 | Day et al. | 52/528 X |
| 3,902,288 | 9/1975 | Knudson | 52/528 |
| 3,967,430 | 7/1976 | Kundson | 52/745 |
| 3,982,373 | 9/1976 | Wilson et al. | 52/588.1 |
| 4,070,805 | 1/1978 | Kastner | 52/86 |
| 4,120,123 | 10/1978 | Knudson | 52/86 |
| 4,291,510 | 9/1981 | Sivachenko | 52/91.3 |
| 4,365,453 | 12/1982 | Lowe | 52/86 X |
| 4,505,084 | 3/1985 | Knudson | 52/528 |
| 4,505,143 | 3/1985 | Knudson | 52/528 X |
| 4,934,121 | 6/1990 | Boyd | 52/521 X |

*Primary Examiner*—Carl D. Friedman
*Assistant Examiner*—Winnie Yip
*Attorney, Agent, or Firm*—Ancel W. Lewis, Jr.

[57] ABSTRACT

A building and method and apparatus for making a building at a job-site location is disclosed. The roof, side walls and end walls are made of similar skin and frame panels that are roll-formed on the job site, cut to length, have holes formed therein and are crimped to form bends in the roof and side wall panels to form interfitting portions at the corner of the roof and side walls. The panels are placed on a framing jig and seamed at connecting flanges and gussets are secured at inside corners to form a roof and side wall building section. These building sections may be a single skin panel and frame panel or multiples thereof. A multiple of two is shown. A roof truss may be fastened to the roof section for wider buildings. The framing jig is adjustable in size and shape to form buildings of different heights and widths. The framing jig shown is lifted by actuating hydraulic cylinders and a formed building section is seamed to a previously raised building section. The framing jig and lifting apparatus is moved along guide rails on the foundation and indexed in holes in the guide rails for the proper location of each newly formed building section. The raised building sections are fastened to the same base members on the foundation that form the guide rails using base clips. Panel assemblies and connecting apparatus are disclosed.

26 Claims, 16 Drawing Sheets

BUILDING AND METHOD AND APPARATUS FOR MAKING, PANEL ASSEMBLIES AND CONNECTING APPARATUS

This is a continuation-in-part of application Ser. No. 810,218, filed Dec. 19, 1991, now abandoned.

TECHNICAL FIELD

This invention relates to buildings and more particularly to a novel and improved building and to a method and apparatus for making a building suitable for job-site construction.

BACKGROUND ART

A common practice in the metal building industry has been to make buildings using rigid steel or wooden frames, and to cover these frames with galvanized steel sheet or painted steel or aluminum sheet. This sheet is rolled to various profiles for stiffening effect, aesthetics, or to facilitate the joining of adjacent cover sheets to each other. These metal buildings have been traditionally designed and fabricated in-plant as kits for complete buildings of a specified dimension, then packaged and shipped to the distributor and ultimately the end user where the parts are finally assembled at the job site. This assembly process requires heavy cranes to erect relatively heavy steel frames and hundreds of hours to screw fasten the metal sheets onto the purlin structures of these frames.

Some of the disadvantages of these prior building practices are that the ultimate user must often order the building well in advance of installation, must absorb high costs in packaging, shipping, insurance as well as final assembly. Nor do these prior practices provide any opportunity for changes in the final dimension or size in the building. Once ordered, the user cannot readily change an original choice.

With regard to earlier building practices, Gross U.S. Pat. No. 586,658 shows a sheet metal ceiling wherein two sections of sheet metal having formed edges are seamed or joined together with a hangar sheet which is itself nailed to a wooden ceiling joist or the like.

Schroyer U.S. Pat. No. 3,312,028 discloses generally channel-shaped panels used on both ceiling and roof structures.

Curran U.S. Pat. Nos. 3,608,267 and 3,557,511 disclose the use of two panels connected together with one panel being provided with an additional web formed as extension of one side wall to form a structural floor.

In earlier patents having the same inventor as the present application a building disclosed therein offered alternatives to many of the above mentioned problems of the rigid-frame pre-engineered building. This building system is identified as K-SPAN and is described in U.S. Pat. Nos. 3,842,647, 3,902,288, 3,967,430, 4,505,084 and 4,505,143. This building has curved metal panels roll formed at the job site, seamed together and placed upright to form round profile buildings of medium span.

DISCLOSURE OF THE INVENTION

In accordance with the present invention there is provided a building that is particularly suited for being constructed at the job site. Both skin panels and frame panels are roll-formed into a desired channel shape from coils of galvanized sheet metal using portable roll-forming apparatus. The roof, side and end walls have the same panel configuration. Both skin and frame panels are fabricated using a portable seamer into an integral panel building section on a framing jig and lifting apparatus that raises the panel building section into place on a foundation, as completed sections of the building. Subsequent panel building sections are assembled, raised and side flanges are interlocked with the flanges of already standing panel building sections and then both sections are typically seamed together by a portable seamer. External fasteners are eliminated or minimized by seaming flanges of skin panels right onto frame panel flanges as well as to each other with a single pass of a portable seamer. No lifting crane is required as panel building sections are set in place by the framing jig and lifting apparatus. A rivet-type fastener is used to join roof and side wall frame panels at adjacent associated frame panels in place of screw or bolt fasteners. The resulting building is more weather resistant, costs less, goes up quicker and has a cleaner exterior appearance.

Another panel assembly and method for making has a skin panel with an inturned connecting flange portion with a terminal section, a frame panel with a transverse connecting flange portion and a second skin panel having an outturned connecting flange portion. The terminal section being turned back over end portions of said inturned and transverse connecting flange portions forming a hem to connect or lock the three panels together at a continuous seam lock.

A panel connecting apparatus has a base plate with two spaced support rollers and a pivot plate connected to the base plate that will move from side to side between two operating positions. An engagement roller mounted on the pivot plate has a first operating position or a second operating position depending on the direction of movement of the apparatus along the panels. The rollers push a connecting flange portion of a frame panel into a connecting flange portion of a skin panel and a connecting flange portion of a second skin panel into the connecting flange portions of the previously connected panels. Another panel connecting apparatus has a support plate on which two spaced guide rollers and an opposed relatively large hem roller are mounted. When moved along the connecting flange portion of three panels the hem roller turns a terminal section of a connecting flange portion of a skin panel down and in to connect, or lock, the three panels together along a continuous seam.

BRIEF DESCRIPTION OF THE DRAWINGS

Details of this invention are described in connection with the accompanying drawings which like parts bear similar reference numerals in which:

FIG. 57 is an enlarged view of the hem and one guide roller in the extended operating position and showing the terminal section turned down and in.

DETAILED DESCRIPTION

Building

Figure 1:
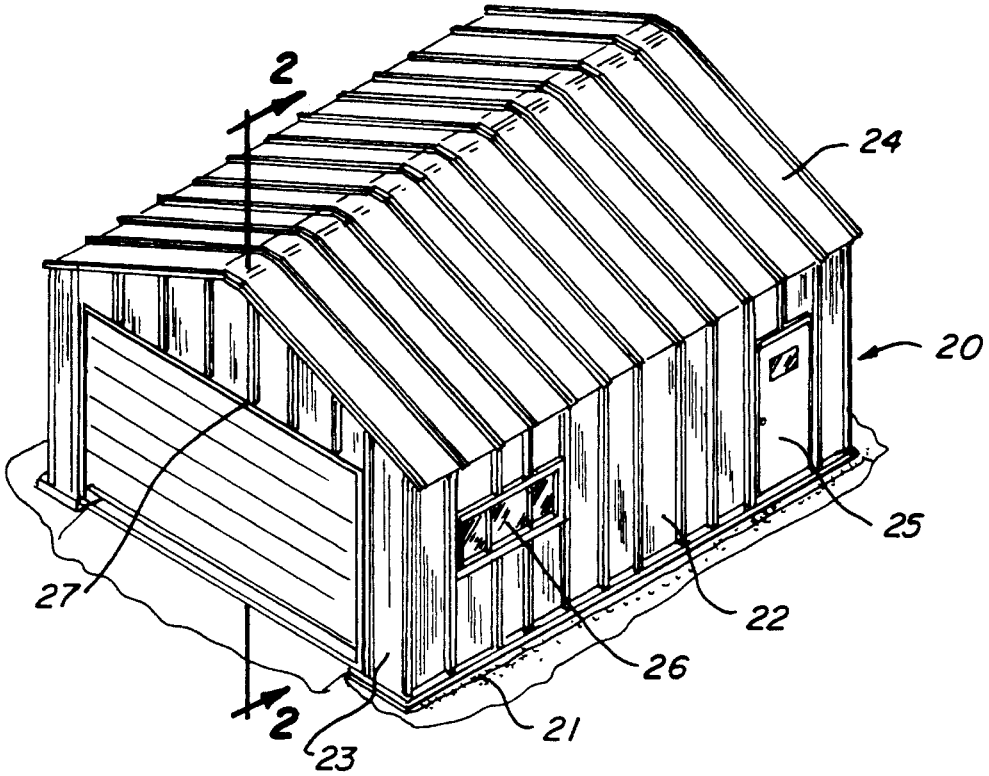
FIG. 1 is a perspective view of a building embodying features of the present invention.
Figure 2:
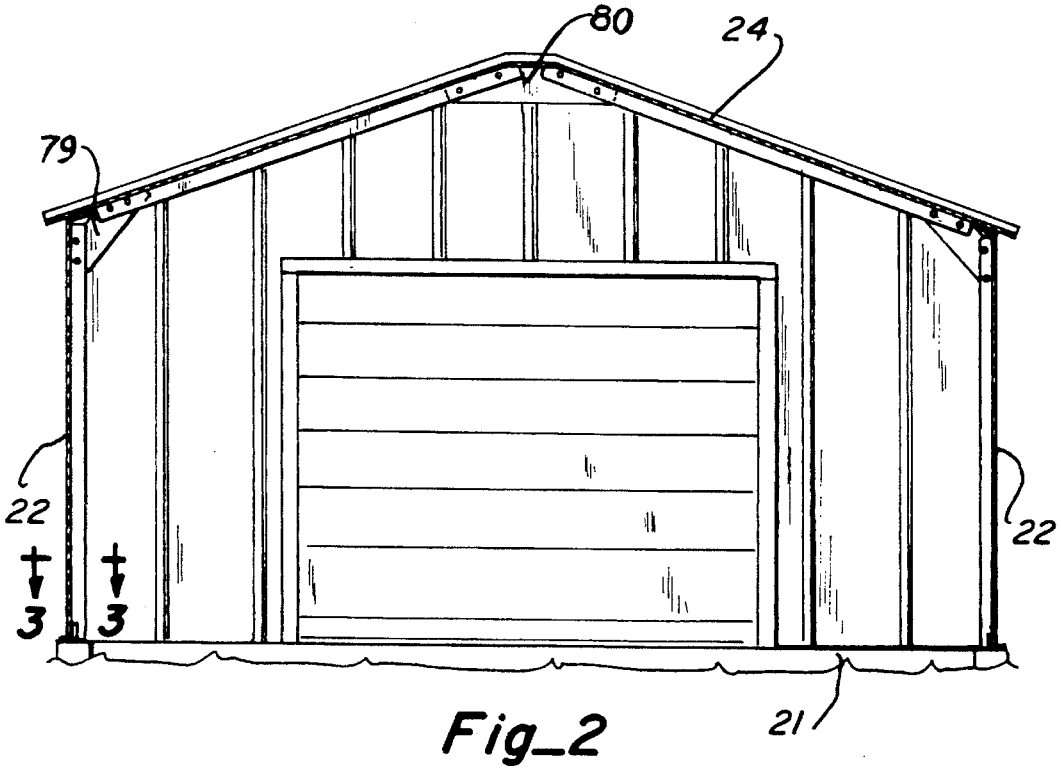
FIG. 2 is a sectional view taken along line 2—2 of FIG. 1.

A building embodying features of the present invention generally designated by reference numeral 20 in general as shown includes a footing or foundation 21 typically rectangular in shape and typically concrete upon which there is supported a pair of oppositely disposed side walls 22 and a pair of oppositely disposed end walls 23. A pitched roof 24 is shown supported on and fastened to the side walls. A typical building may have a door 25 and a window 26 in a side wall and may have a drive-in entry 27 in an end wall.

Guide and Anchor Base Assembly

A base member 31 of right angle profile extends in a straight line along the top of the foundation and is suitably fastened thereto as by anchor bolts 32. The base member has an inturned bottom leg 33 and an upright leg 34. The bottom leg is provided with holes 35 disposed at selected distances apart, typically 18 inches, which receive the upper ends of the anchor bolts 32 and have nuts threaded thereon to anchor the base member 31 to the foundation. The upright leg is provided with holes 36 a selected distance apart, typically 18 inches, provides fixed locations for the side wall frame panels and also serves to index or locate the framing jig and lifting apparatus 90 described hereinafter at the correct position as the building is assembled. The upright legs 34 form a pair of parallel spaced guide rails for the framing jig and lifting apparatus 90. The holes 35 in the bottom leg are shown offset 9 inches from the holes in the upright leg.

Figure 5:
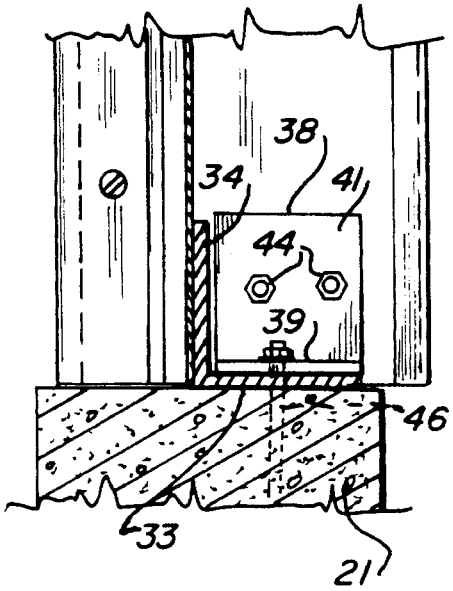
FIG. 5 is a sectional view of an alternative mounting for the base clip shown in FIGS. 3 and 4.
Figure 4:
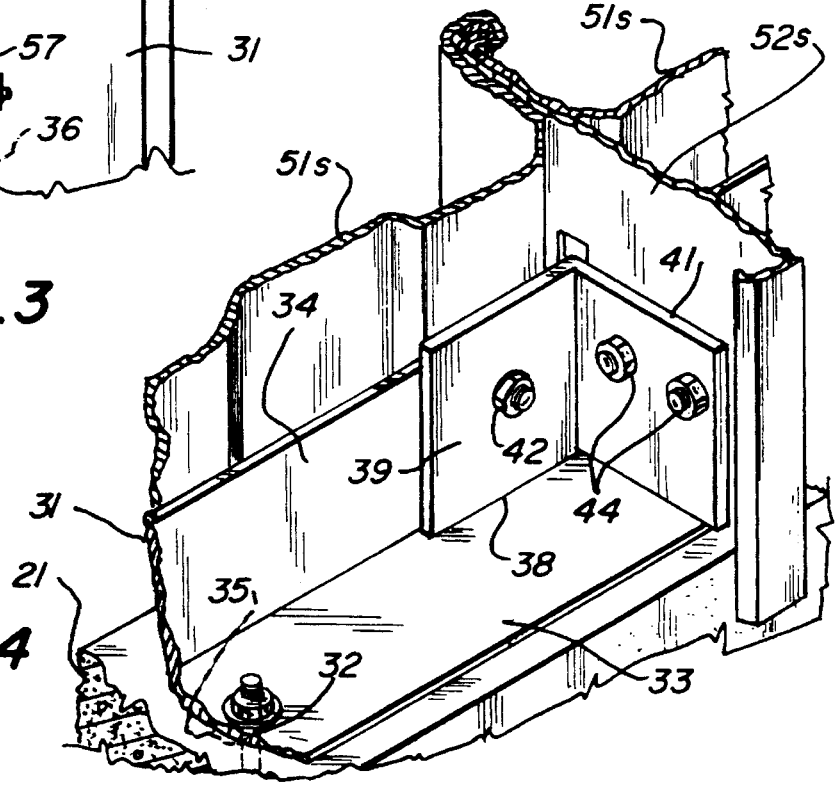
FIG. 4 is a perspective view of FIG. 3.

A base clip 38 of right angle profile with two legs 39 and 41 is used to fasten or anchor the bottom of each side wall frame panel to the base member 31. Referring now to FIGS. 4 and 5 each base clip 38 is arranged on its side with one leg 39 fastened to the upright leg 34 of the base member by a bolt and nut fastener 42. An alternative to nuts and bolts for fastening the base clips would be welding. The other leg 41 of the base clip is shown fastened to the side wall frame panel 52S by a pair of spaced bolt-nut fasteners 44. An alternative fastening or anchoring shown in FIG. 5 has the base clip 38 upright on the bottom leg 33 of the base member. A screw and nut fastener 46 extends through holes in the bottom leg 33 and base leg 39 and a nut is threaded to the screw. The other leg 41 of the base clip is fastened to the side wall frame panel by the two bolt-nut fasteners 44 the same way as in FIG. 4.

Skin and Frame Panels

Both the walls and the roof of the building are made up of a plurality of similar skin panels and frame panels. The side wall skin panels are designated 51S and the roof skin panel 51R. The side wall frame panels are designated 52S and the roof frame panel 52R. These panels are made at the job site using portable roll-forming apparatus preferably mounted on a trailer for portability that takes coil stock and forms the panels into a desired shape and cuts the panels to the desired length.

Figure 8:
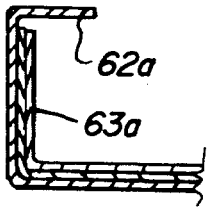
FIG. 8 is a sectional view of an alternative flange connecting portion for the skin panel prior to seaming.
Figure 9:
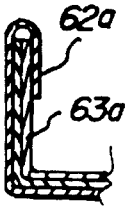
FIG. 9 is a sectional view of the seamed joint using the flange connecting portion of FIG. 8.
Figure 7:
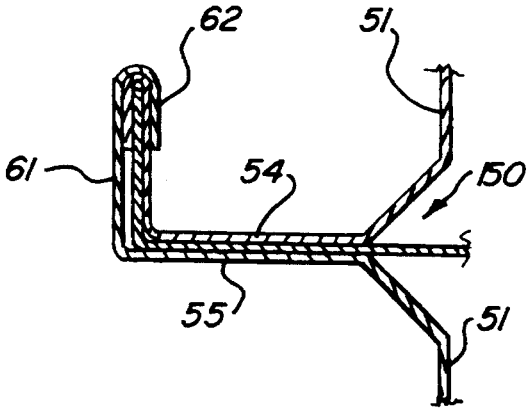
FIG. 7 is a sectional view similar to FIG. 6 after seaming.

Generally, each skin panel is generally channel-shaped and has a generally flat intermediate base 53 and two side walls 54 and 55 extending away from opposite sides of the base. The panels may take different channel-shaped configurations but the preferred one shown has two laterally spaced longitudinal ribs 56 in the base for strength and has angled corner sections 57 at the corners of the base and side walls. A female connecting flange portion 58 is provided at the extremity of one side wall and a male connecting flange portion 59 is provided at the extremity of the other side wall. The female connecting flange portion 58 specifically has an inturned section 61 and a downturned end flange 62. For some assembly situations end flange 62 may extend laterally straight out. The male connecting flange portion has an inturned flange section 63 looped back at a bend and an inturned flange section 64. Referring now to FIGS. 8 and 9 there is shown an alternative male flange **63*a* that does not loop back. The male flange 62*a*** folds back over only two thicknesses. Each skin panel preferably is sheet metal and has a thickness in the range of about 0.02 to 0.04 inches.

Each frame panel 52S or 52R has an intermediate web 66 and a side wall 67 and end flange 68 extending away from opposite sides of the web and generally transverse thereto. End flange 68 is a male flange connection portion. Side wall 67 has an end flange 69. Each frame panel preferably is sheet metal and has a thickness in the range of about 0.03 inches to 0.07 inches.

Dual Skin-Single Frame Panel Section

Figure 6:
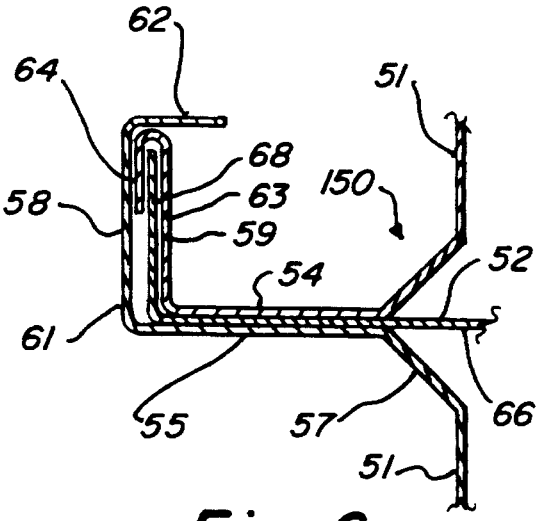
FIG. 6 is a sectional view through the flange connecting portions of two skin panels and one frame panel shown in FIG. 3 prior to seaming.

A dual skin-single frame panel section 150 used in both the side and end walls and the roof has the male connecting flange portions 68 and 59 of a frame panel and a second skin panel disposed inside the female connecting flange portion of the first frame panel with the end flange 62 of the first panel turned in and under the male connecting flange portions 68 and 59 to form a continuous seam that secures the two skin panels and the frame panel together. This seam is usually done by a portable seamer that moves along the panels once they are placed in the position as shown in FIGS. 6 and 8. Seamers suitable for this purpose are disclosed in U.S. Pat. No. 4,726,107.

Roof-Side Wall Corner Joint

Figure 10:
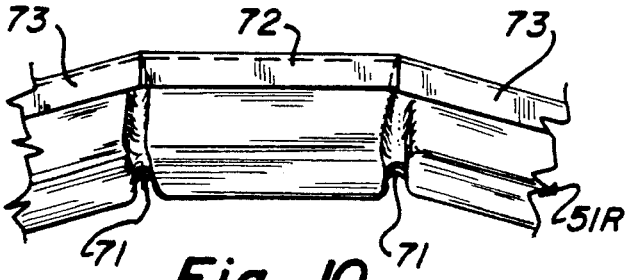
FIG. 10 is a side elevational view of a portion of the crimped roof skin panel.
Figure 11:
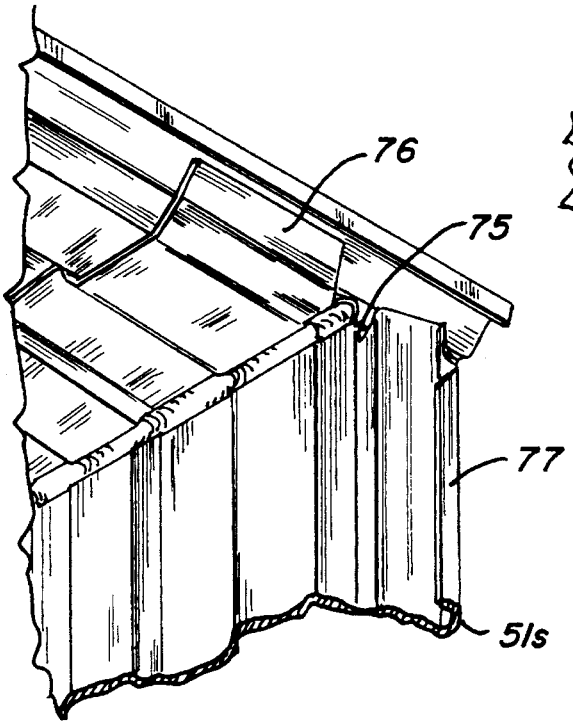
FIG. 11 is a bottom inside perspective view of the crimped side wall panel and portion of the interfitting roof panel.
Figure 13:
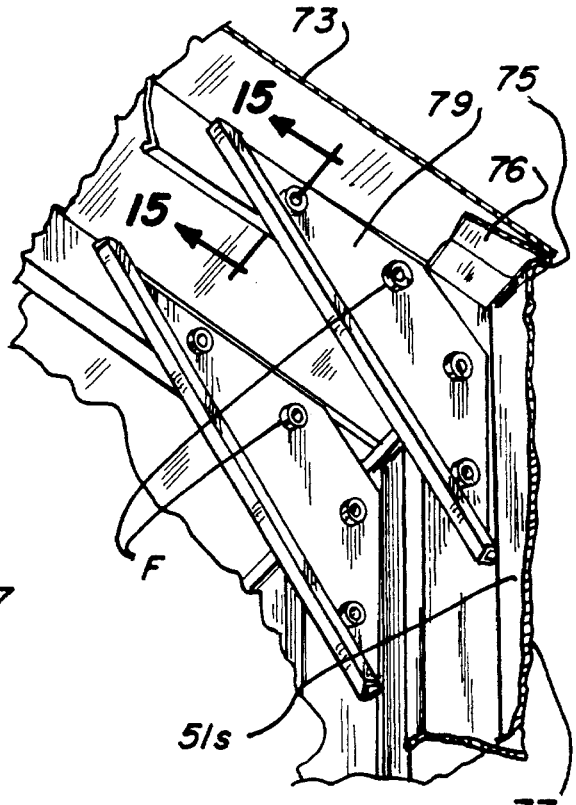
FIG. 13 is a perspective view of the gusset plates fastening the roof and side wall frame panels.
Figure 12:
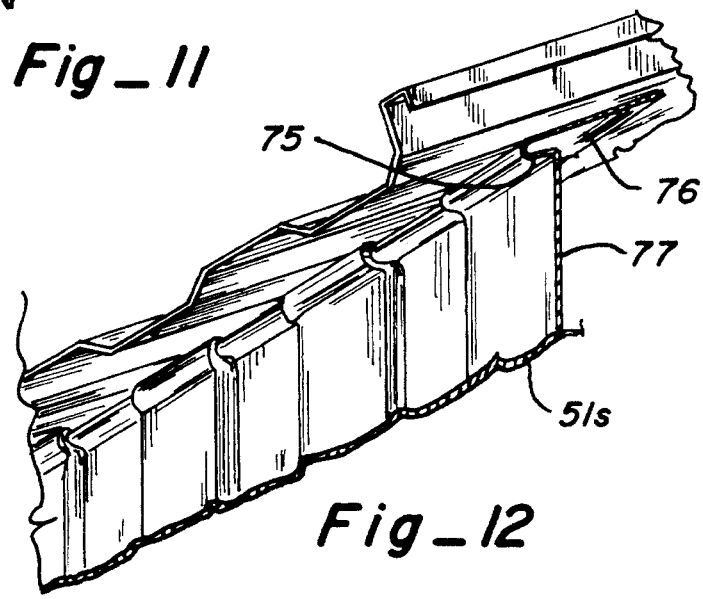
FIG. 12 is a bottom outside perspective view of FIG. 11.

The panels for both the roof and side and end walls are initially roll formed as a skin straight panel that is cut to a selected length. In the roof skin panel 51R two spaced crimps or bends 71 are put in each panel intermediate its length to form an intermediate apex section 72 and two oppositely disposed end sections 73 as seen in FIG. 10. Each side wall skin panel 51S is initially made as a straight panel that is cut to a selected length and then a crimp or bend 75 of a selected inside angle such as 75° is put in the panel a short distance in from the top end to provide an inclined section 76 and a vertical section 77. The side wall-roof inside corner joint is made by having an end portion of the end section 73 of the roof skin panel nesting in the inclined section 76 of the side wall skin panel and extends beyond the side wall skin panel a short distance to provide a roof overhang. The profiles or cross sections of the roof and side wall panels are complementary in shape so they nest in and interfit with one another as seen in FIGS. 11 and 12. Only the skin panels and not the frame panels are crimped as above described.

Figure 14:
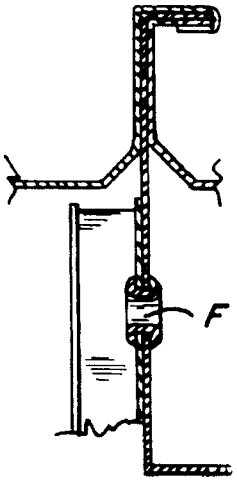
FIG. 14 is a sectional view taken along line 14—14 of FIG. 13.

A corner gusset plate 79 is fastened between each side wall frame panel 52S and the adjacent aligned roof frame panel 52R along the inside upper corner of the building as seen in FIG. 14. This gusset plate is a piece of sheet metal that is cut to a shape to fit in the inside upper corner. A gusset plate 80 is fastened to the frame panels at the apex inside the roof sections. The gusset plates fasten to the frame panels of the walls and roof to provide structural rigidity. Holes are punched in each gusset plate and in the frame panels and a rivet-type fastener F is used to make the connection. This is done on the framing jig and lifting apparatus prior to lifting the single roof-single side wall panel building section 160 into place as is described hereinafter. The rivet-type fastener F is described in detail in my above mentioned copending application entitled FASTENING APPARATUS AND METHOD AND RIVET-TYPE FASTENER. This fastener F shown has a rolled flange at opposite ends of a size larger than the holes through which it passes and has an internal diameter at least four times the thickness of the panels and trusses through which it passes. The preferred ratio is in the range of about 4 to 1 to 15 to 1. The external diameter of the fastening section is in the range of about 0.5 to 1.50 inches.

Roof Trusses

For a wider building, roof trusses preferably are added to the roof section. The A-type roof truss 81 shown in FIG. 15 has a horizontal member 82 extending between the gusset plates 79 at the inner corners. The roof skin panel 51R is the same on both sides of the roof apex. Each side section of the roof is divided into two equally spaced connecting points between the apex and outer end to provide three parts of equal length. A diagonal strut member 83 extends from the outer connecting point to a connecting point midway between the middle of the horizontal member 82. A diagonal strut member 84 connects between the connecting point with members 83 and 82 and the inner connecting point of the roof side section. A diagonal member 85 extends between the inner connecting point to the midpoint of the horizontal member. A vertical strut member 86 extends between the apex of the roof and midpoint of the horizontal member.

Figure 17A:
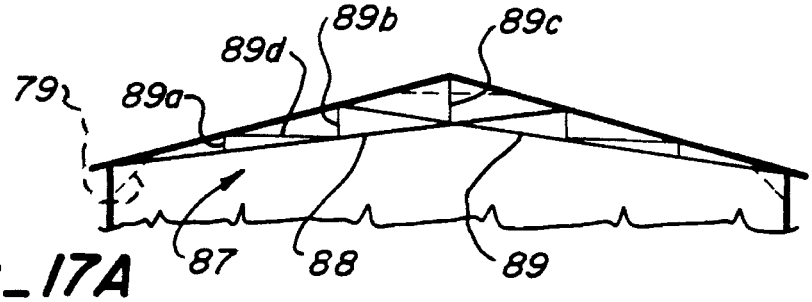
FIG. 17A is a schematic diagram of one form of scissors-type roof truss.
Figure 17B:
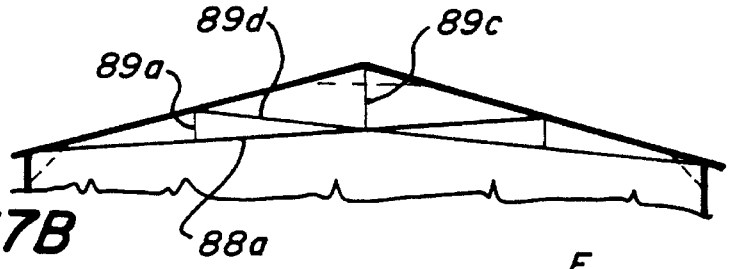
FIG. 17B is a schematic diagram of another form of scissors-type roof truss.

The scissors-type roof truss 87 shown in FIG. 17A again has each half of the roof section divided into thirds by two connecting points between the apex and outer end. A diagonal member 88 on each side extends from the gusset plate at the top of the side wall to an inner connecting point on the opposite roof section with respect to the apex. Vertical strut member sections 89*a* and 89*b* connect the upper and lower sections. A central vertical strut member 89*c* extends between the apex and the intersection of the two diagonal members. A diagonal strut member 89*d* connects between the roof section and diagonal member between upper and lower connection portions. An alternative roof truss shown in FIG. 17B has the diagonal strut member 88*a* extend to the midpoint of the opposite roof section and uses only an intermediate vertical strut member 89*a* and a center vertical strut member 89*c*.

The truss members are shown fastened to the side wall and roof frame panels using the above described rivet-type fasteners F. This assembly is done prior to lifting the single roof-side wall panel building section 160.

Framing Jig and Lifting Apparatus

The framing jig and lifting apparatus 90 shown, in general, includes a pair of laterally spaced side base members 91 each having a side pivot arm 92 pivotally connected at one end to an end of the associated side base member by a pivot shaft 93 to rotate about a pivot axis X. The framing jig includes a pair of parallel spaced side wall supports 95 mounted on associated side pivot arms 92, a pitched roof support 96 connected to the upper ends of the side wall support and a lateral support 97 connected between the side wall supports 95. To lift the framing jig, a pair of hydraulic cylinders 98 are connected between each side base member 91 at pin 98*a* and the associated end frame of lateral support 97 at pin 98*b* on a clevis which when extended will raise the framing jig from a down to an up position and return the framing jig to the down position when retracted. It is understood that other motive power could be used to raise and lower the framing jig such as a hoist on a truck or the like.

Figure 29:
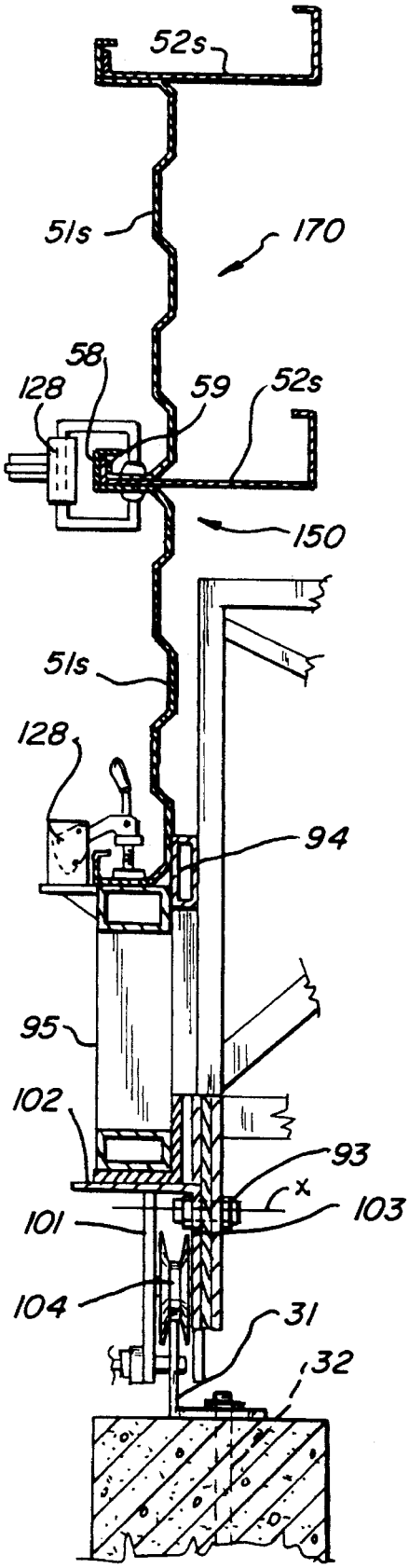
FIG. 29 is a sectional view taken along line 29—29 of FIG. 28.

Each side base member 91 has an outer side plate 101, top plate 102 and inner side plate 103 with three spaced flanged rollers 104 mounted between the outer and inner plates. Each flanged roller has a groove to receive the upstanding leg of the base member along which it rolls. Two indexing mechanisms 106 are shown mounted to the outer side plates at spaced positions. Each indexing mechanism 106 includes a pin 107 moved by a lever 108. An indexing mechanism found suitable is a model CL 250 TPC manufactured by Carr Lane Manufacturing Company, St. Louis, Mo. Each side pivot arm 92 includes a base plate 111 and an intermediate upright plate 112. An associated side wall support 95 rests on and extends along and is fastened to the outside of the upright plate 112 by bolts 113 to enable different lengths of side wall supports 112 to be readily interchanged. One end of the lateral support 97 extends along and is fastened to the inside of the upright plate 112 by bolts. The side wall supports 95 are provided with a plurality of spaced upright plates 94 along one side which provide a support surface for the side wall and base of the skin panel as seen in FIG. 29.

The side wall supports 95 are of a truss type construction including parallel spaced longitudinal members with transverse members and diagonal members connected at the ends to the longitudinal members. The side supports are made in selected different lengths such as a 10 foot section 95*a*, a 12 foot section 95*b* and a 14 foot section 95*c* and are interchangeable to enable buildings of different heights to be constructed.

The roof support 96 is also of a truss-type construction including parallel spaced longitudinal members with transverse members and diagonal members connected at the ends to the longitudinal members. The roof support has an apex section 99 and interchangeable roof end sections 100 of different lengths to accommodate buildings of different widths. The roof end sections shown are a 24 foot section 100*a* and a 36 foot section 100*b* as examples. In practice, 24, 30, 36 and 42 foot lengths are used.

Figure 26:
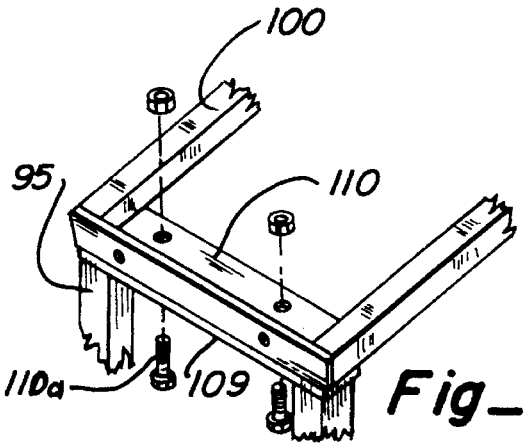
FIG. 26 is a perspective view showing the fastening of the roof support end section to the side wall support section.
Figure 27:
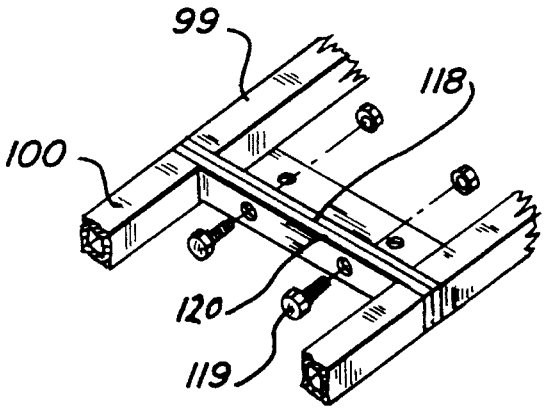
FIG. 27 is a perspective view of the fastening of the roof apex section to the interchangeable roof support end section.
Figure 28:
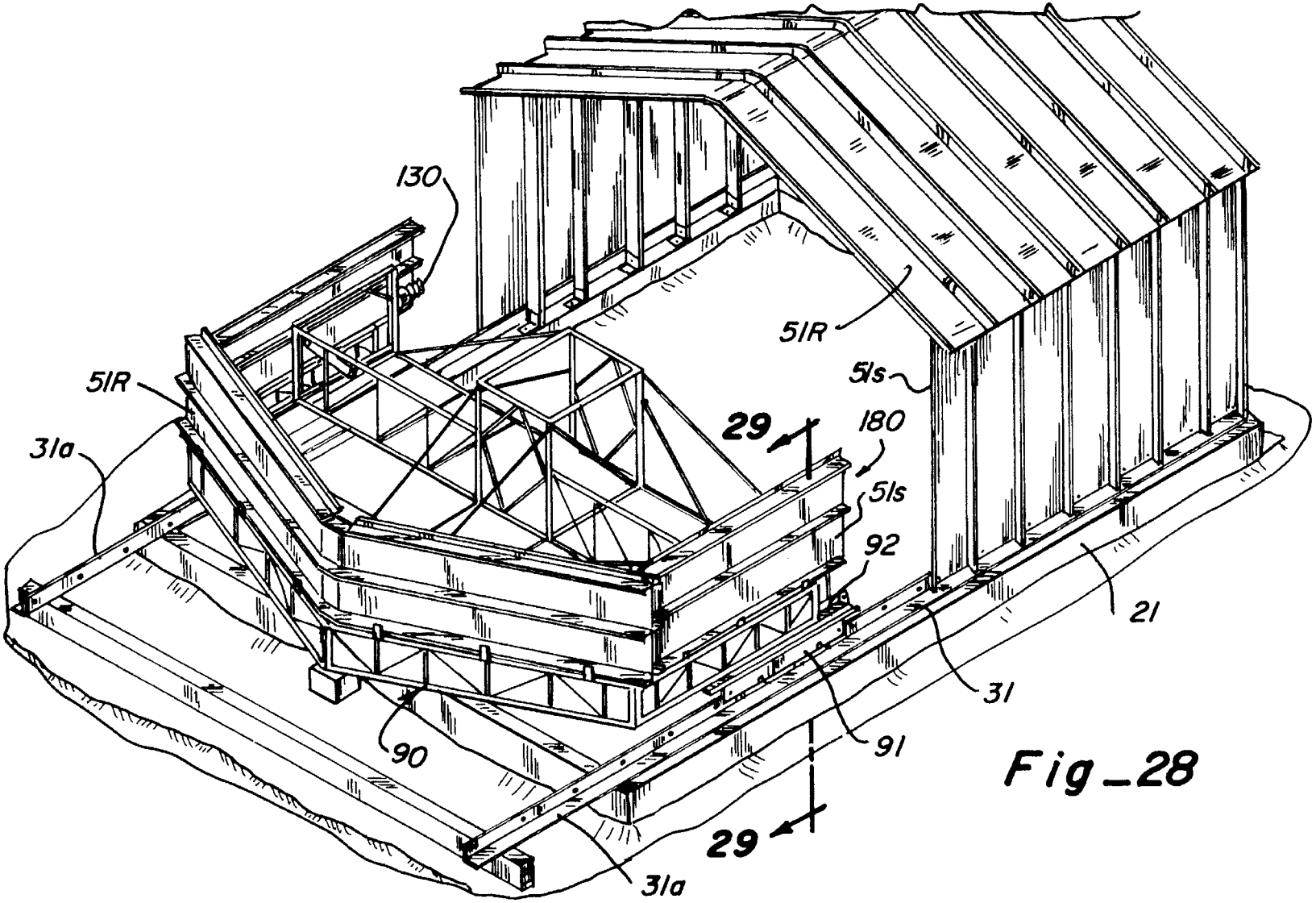
FIG. 28 is a perspective view of an assembled skin and frame panel section shown mounted on the framing jig and lifting apparatus.
Figure 30:
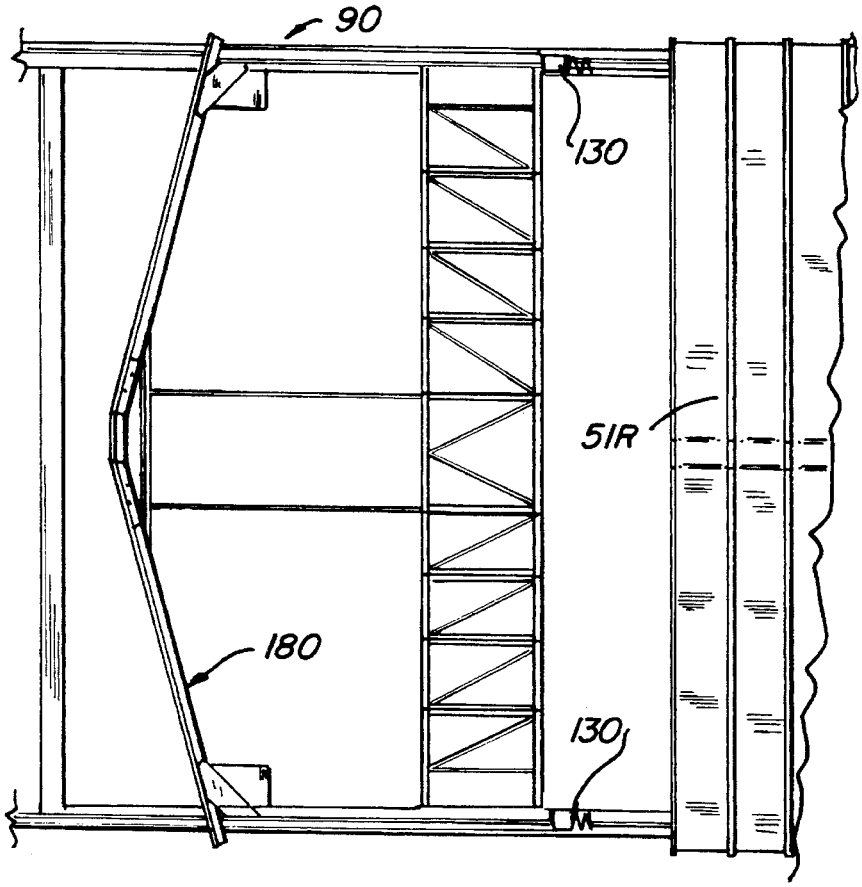
FIG. 30 is a top plan view of FIG. 28.

Referring now to FIG. 26 the upper end of the side support 95 has an end plate 109 and the end section 100 of the roof has a flat plate 110 and bolt and nut fasteners 110*a* extend through holes in these end plates to afford ready interchangeability. The roof end section 100 has an end plate 120 and apex section 99 an end plate 118 with holes that receive bolt fasteners 119 to afford ready interchangeability of roof end sections 100.

The lateral support 97 is constructed to have its lateral extent or width dimension readily changed to provide for the construction of buildings of selected different widths. In the embodiment shown and described herein the lateral support will accommodate buildings having widths of 24 feet to 42 feet in 6 foot increments.

The lateral support 97 has a pair of identical fixed width end sections 114 (17 inches), a fixed width inside section 115 (26 inches), that co-operates with the end section, at least two interchangeable intermediate sections 116 (36 inches), and a fixed width center section 117 (54 inches). The width of the lateral support is changed by changing the number of intermediate sections 116.

Each end section 114 includes a rectangular end frame having spaced upright members 122 and 123 secured at lower ends to side pivot arm 92 and a top member 124 arranged in a rectangular configuration. A coil spring 130 fastens to member 122 to absorb the shock of the support assembly being disposed upright. Tubular sections 126 of a selected length extend inwardly from each of the corners of the end frame. The inside section 115 has three tubular sections 127 that are telescopically received in associated of the tubular sections 126 of the end section. The intermediate sections 116 bolt fasten to one another and to the center section. Each intermediate section 116 is generally L-shaped with an upright box forming one leg and a base box forming the other leg along with diagonal members for each box and a diagonal member connecting the boxes. These intermediate sections 116 stack for convenience of shipping.

For making a 24 foot wide building two intermediate sections 116 are used on each side. A 30 foot wide building has three intermediate sections for each side. A 36 foot wide building has four intermediate sections on each side. A 42 foot wide building has five intermediate sections on each side.

Assembly Method

A full sequence of constructing the building using the above described panels are apparatus will now be described. The building width is selected using a selected number of intermediate sections 116 and a selected length of roof end section 100. Referring now to FIG. 29, a pair of side wall skin panels 51S and a roof skin panel 51R are placed on the associated supports of the framing jig. This framing jig locates the formed panels and clamps 128 hold the panels in position on the side wall supports 95 and roof support 96.

In sequence, for forming both the side walls, end walls and roof sections, the male connecting flange portion 68 of a first frame panel is inserted into the female connecting flange portion 58 of the first skin panel followed by the insertion of the male connecting flange portion 59 of a second skin panel into the female connecting flange portion of the first panel. A seamer then joins the two skin panels to the frame panel to form a dual skin-single frame panel section 150. The gusset plates 79 are riveted with fasteners F at the juncture between the seamed roof frame panel and the upper end of each seamed side wall frame panel to form a single roof-single side wall panel building section 160. Gusset plate 80 may then be fastened in place. The male connection flange portion 59 of a second frame panel is inserted into the female flange portion of the second panel and clamped in place by clamps 128 on support plates 128*a*. This then forms a dual skin-dual frame panel section 170 which when done for both side walls and roof provides a dual roof-dual side wall panel building section 180.

Figure 15:
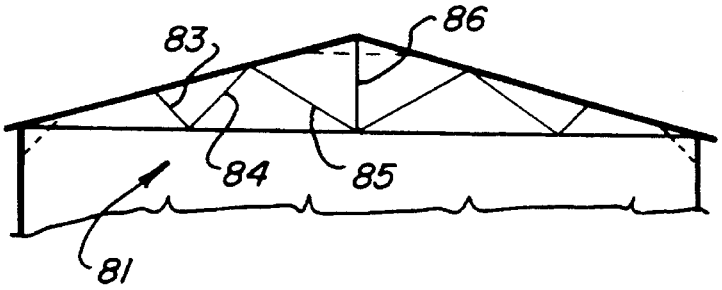
FIG. 15 is a schematic diagram of an A-type of roof truss.
Figure 16:
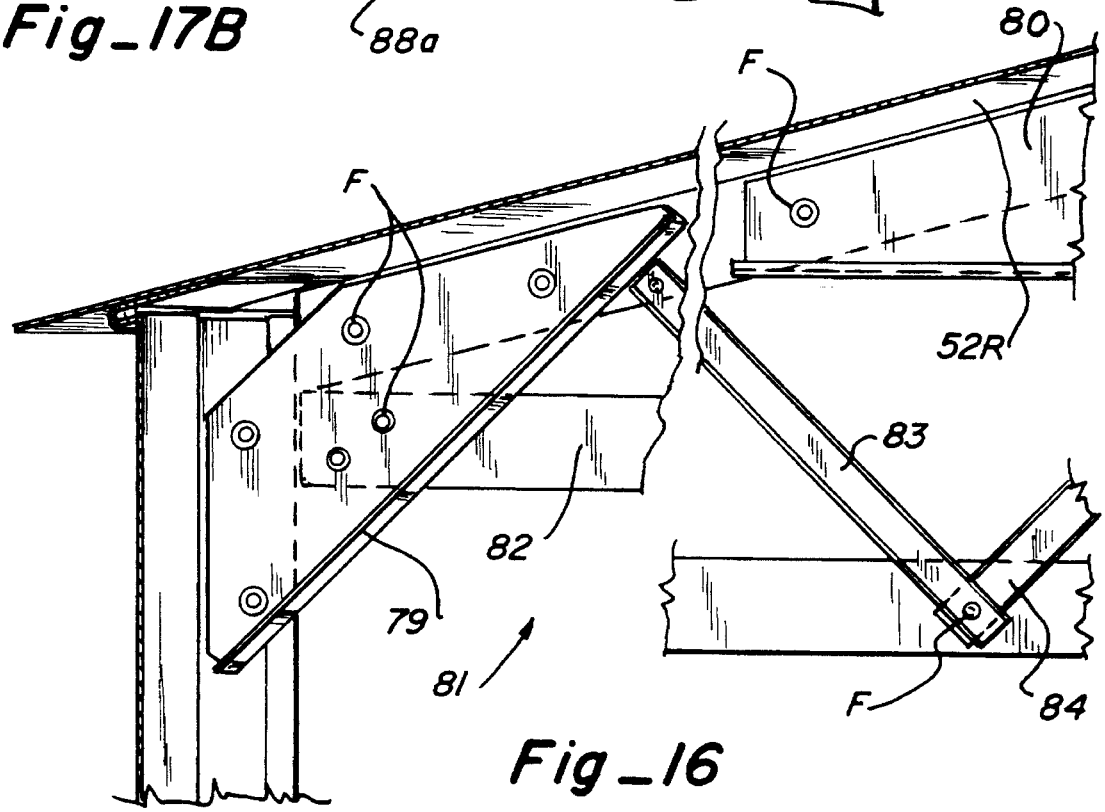
FIG. 16 is an end elevational view of a portion of the truss structure shown in FIG. 5.
Figure 19:
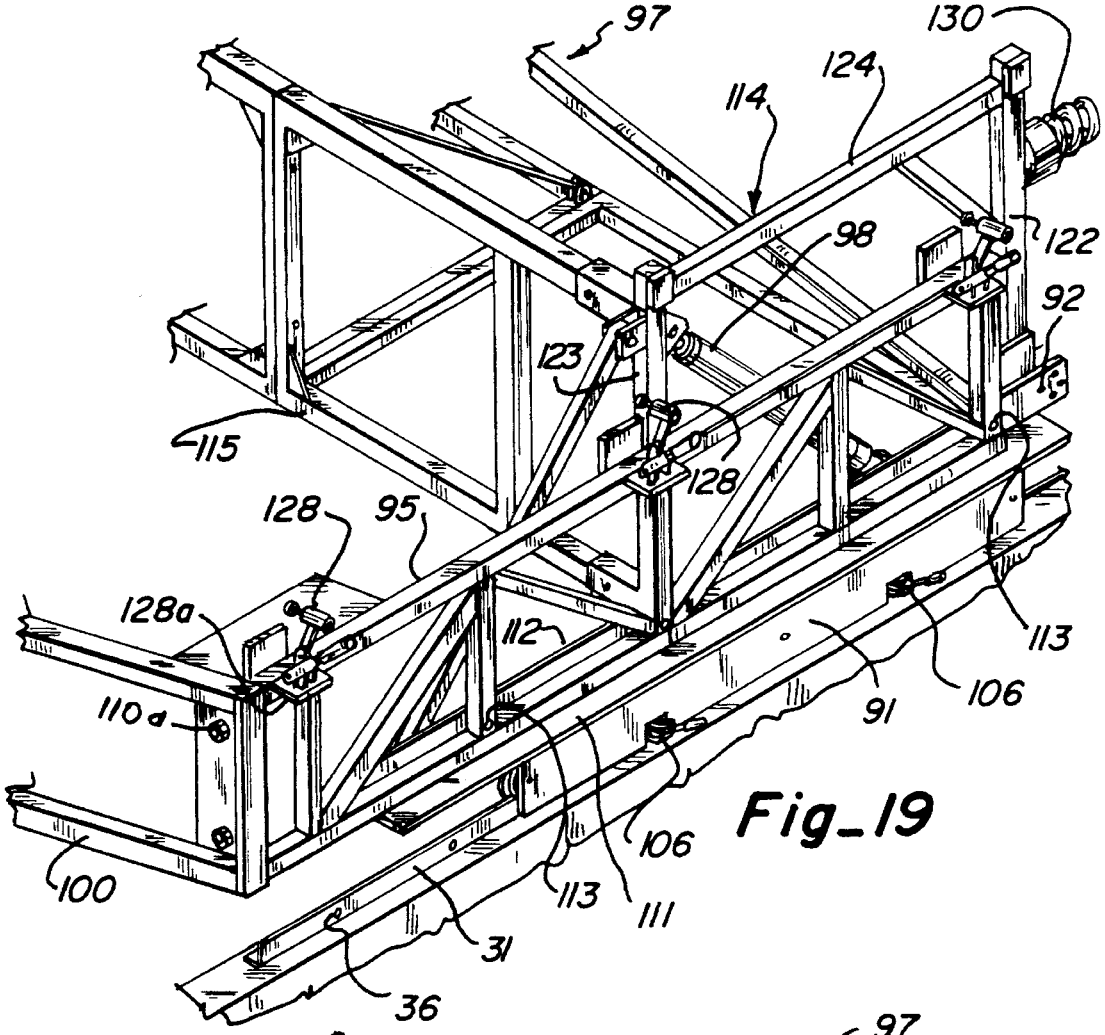
FIG. 19 is an enlarged perspective view of a portion of FIG. 18.
Figure 18:
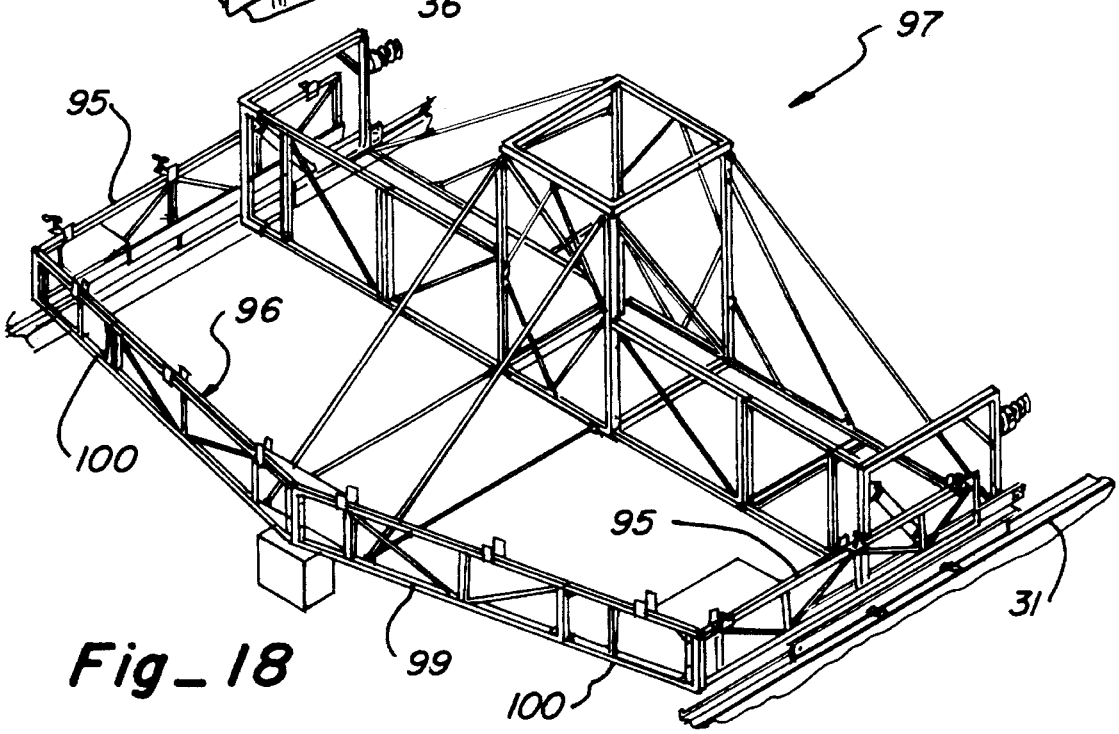
FIG. 18 is a perspective view of a framing jig and lifting apparatus in a lowered position.
Figure 20:
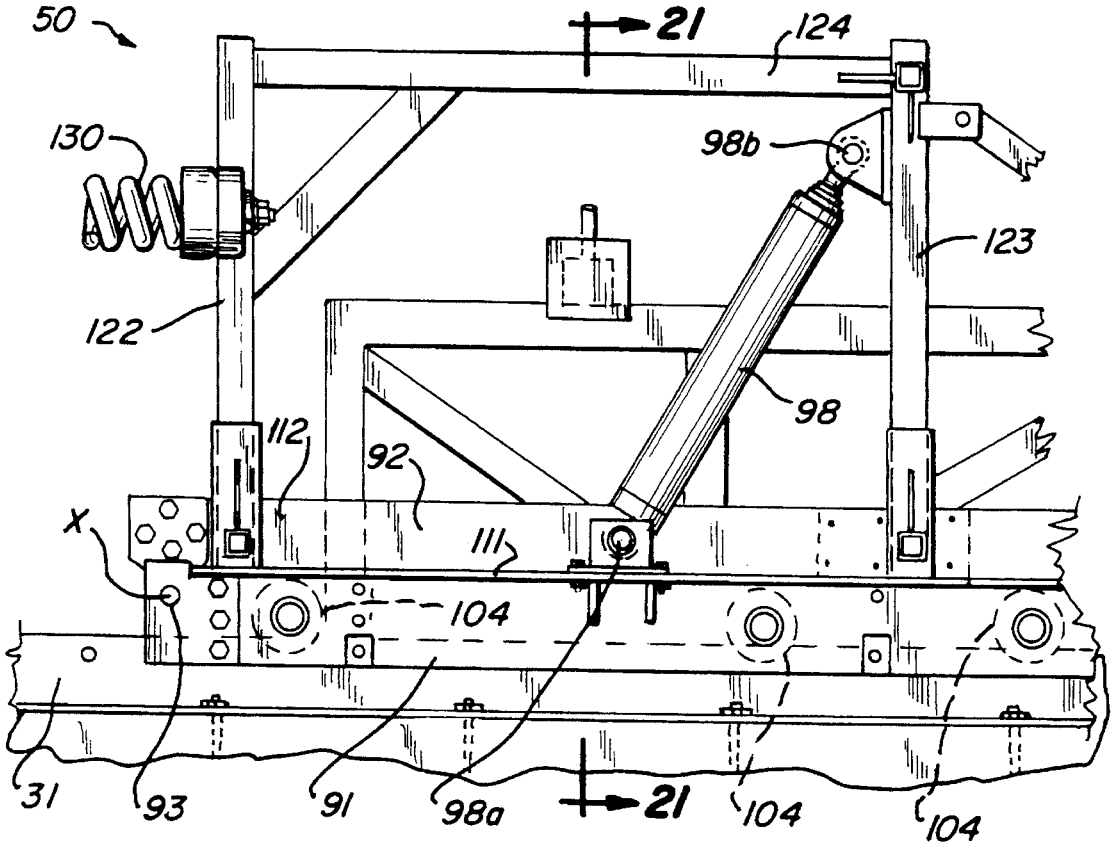
FIG. 20 is an end elevational view of a portion of the framing jig and lifting apparatus in the down position.
Figure 21:
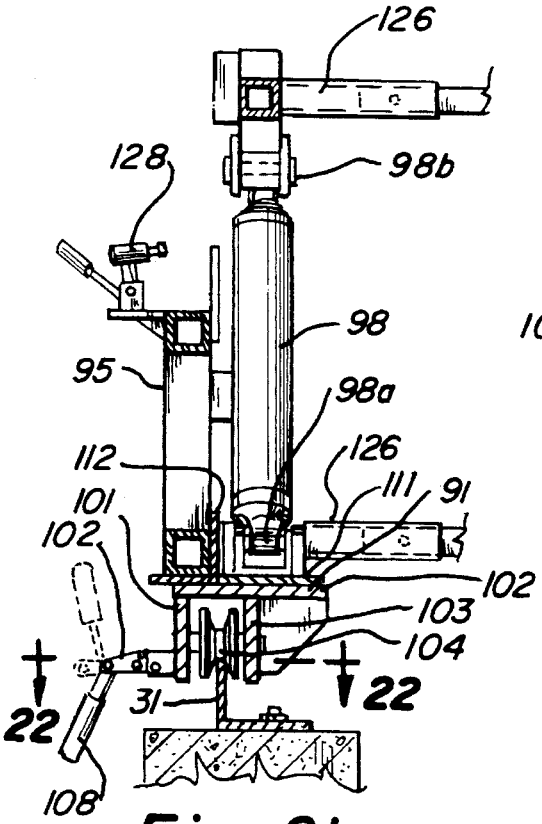
FIG. 21 is a sectional view taken along line 21—21 of FIG. 20.
Figure 22:
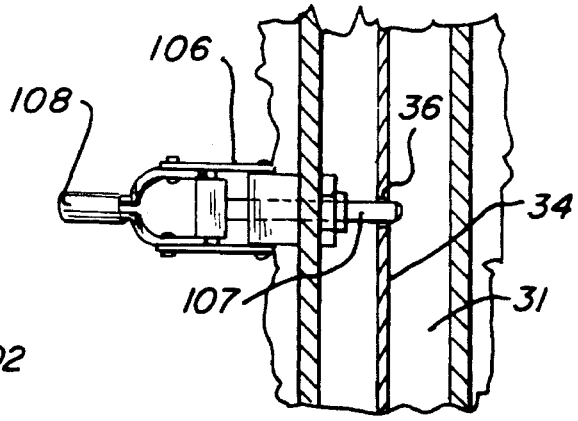
FIG. 22 is a sectional view taken along line 22—22 of FIG. 21.
Figure 23:
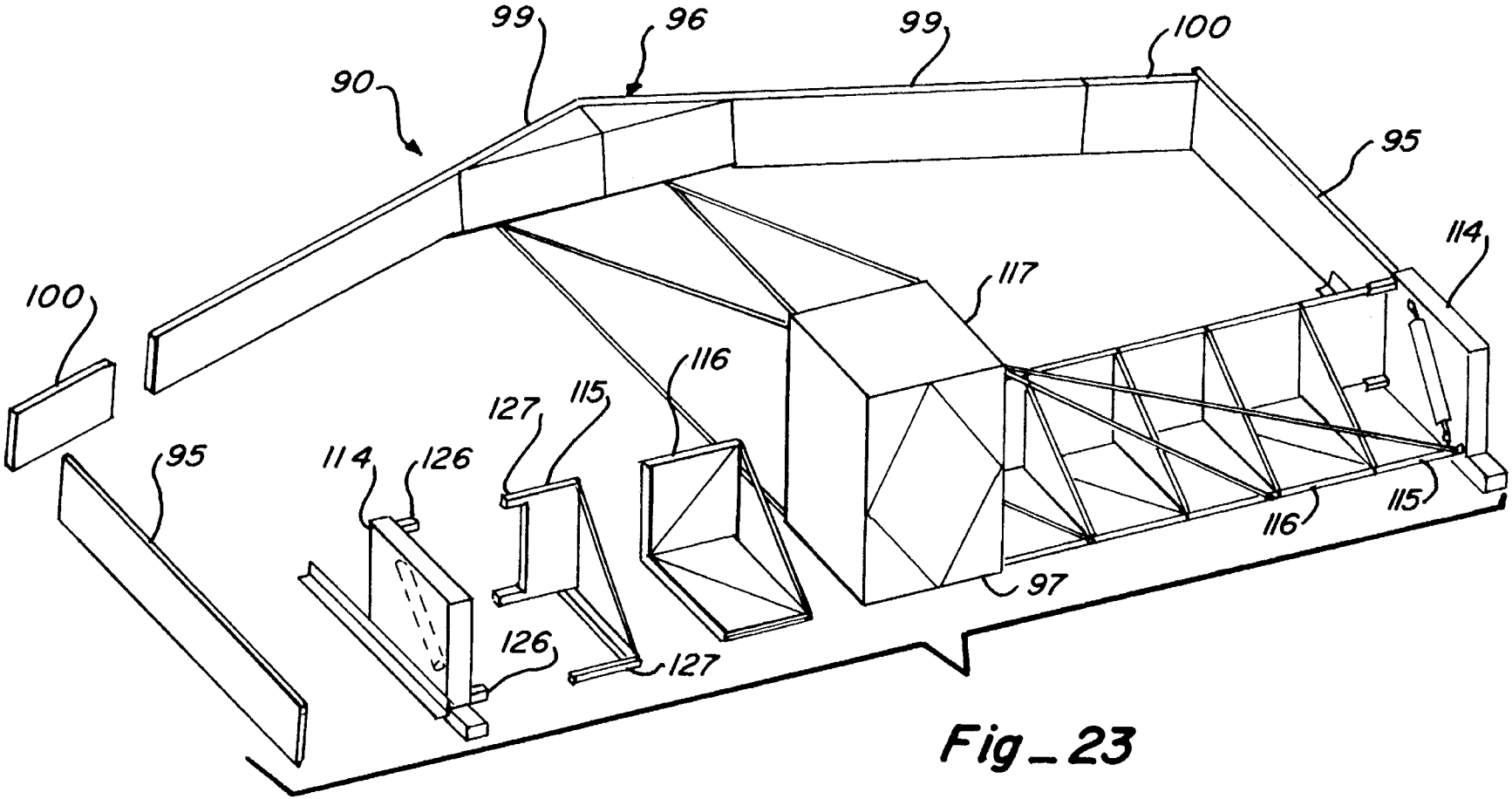
FIG. 23 is an schematic, partially exploded view of the roof, side wall and lateral supports.
Figure 24:
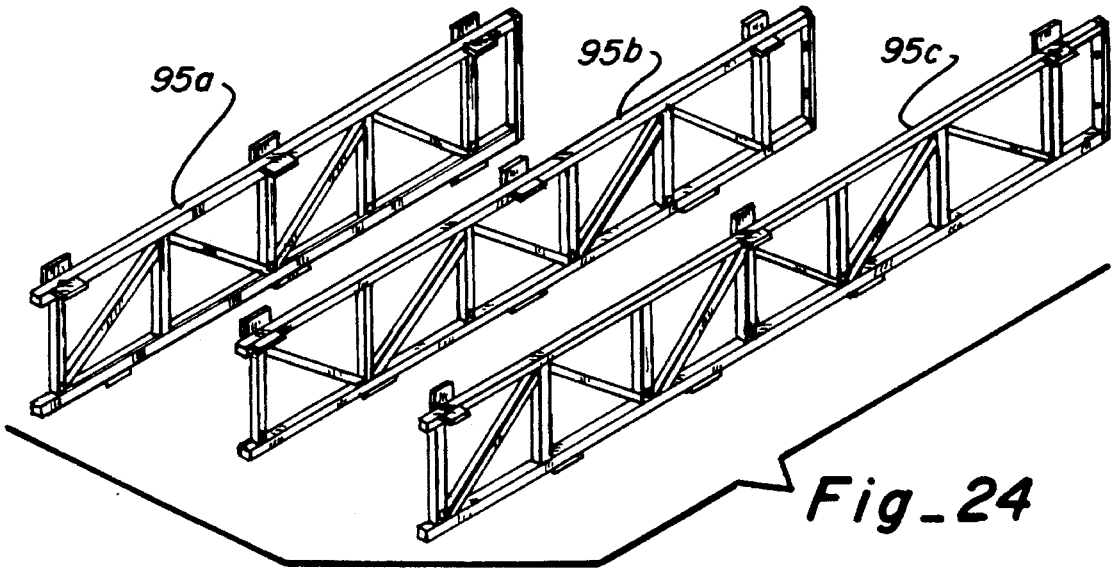
FIG. 24 is a perspective view of the side wall supports of three different lengths.
Figure 25:
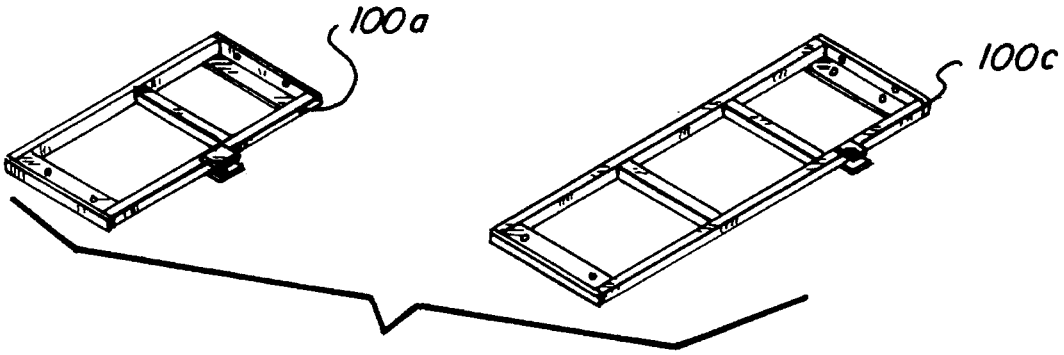
FIG. 25 is a perspective view of two roof sections of different lengths.
Figure 33:
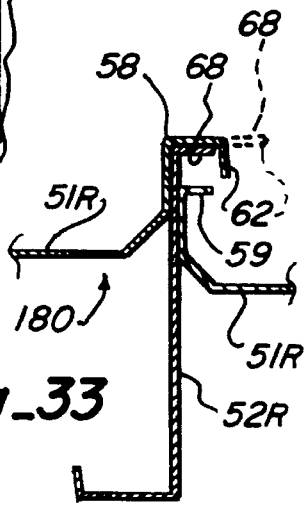
FIG. 33 is a sectional view of the raised panel section prior to being moved to a lowered position as seen in FIG. 32.
Figure 31:
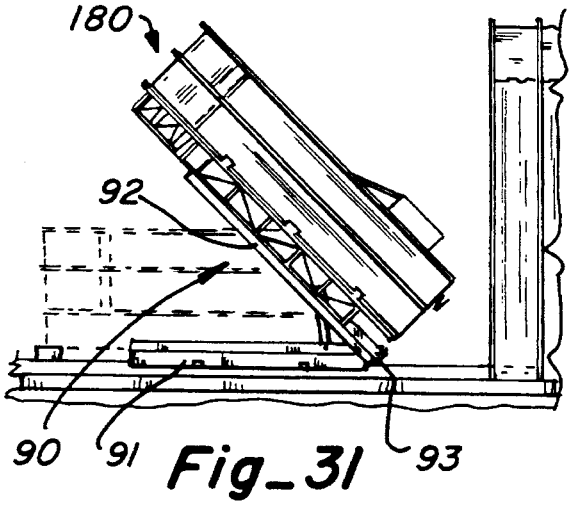
FIG. 31 is an end elevational view showing the framing jig and lifting apparatus with panels partially raised.
Figure 32:
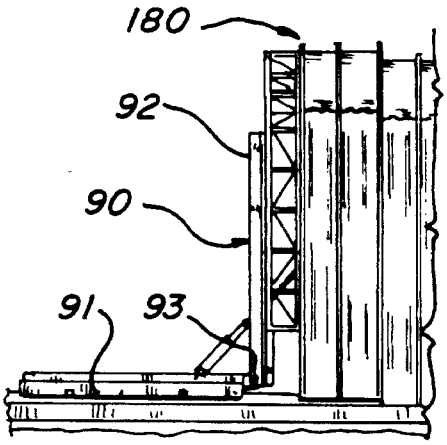
FIG. 32 is a side elevational view showing the framing jig and lifting apparatus with panels in a fully raised position and fastened to an adjacent panel section.
Figure 34:
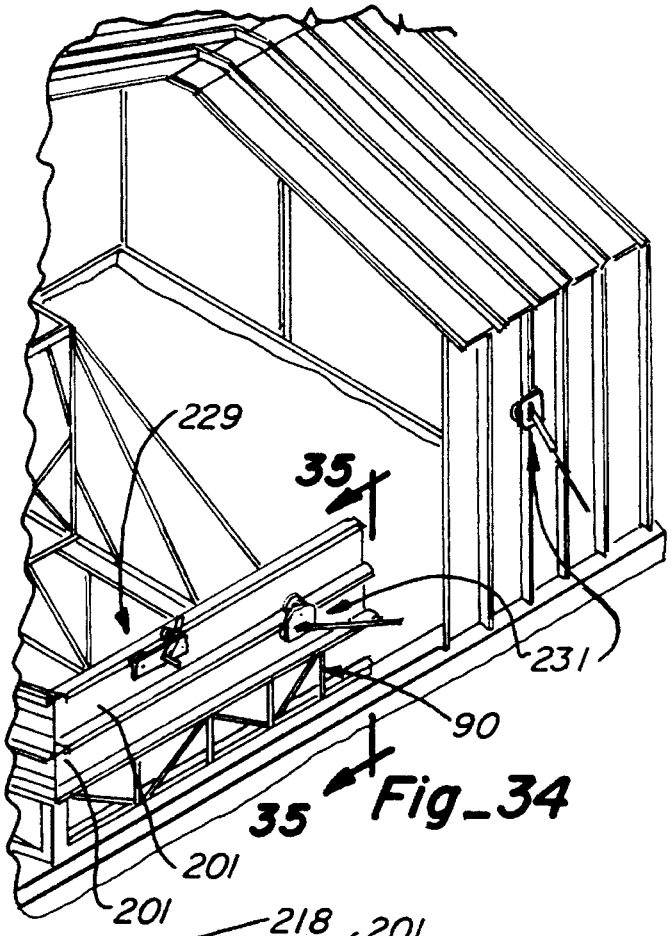
FIG. 34 is a perspective view of a skin and frame panel assembly shown in a down position mounted on a jig and lifting apparatus with connecting apparatus in place on the down panel assembly and a raised panel assembly.
Figure 36:
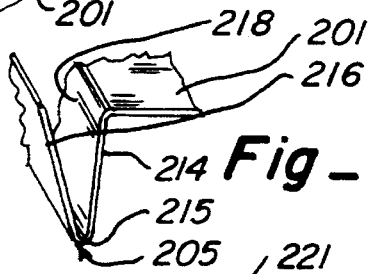
FIG. 36 is a perspective view of inturned connecting flange portion of a skin panel.
Figure 37:
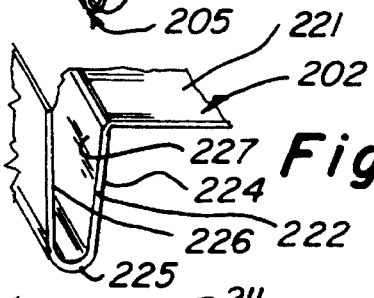
FIG. 37 is a perspective view of transverse connecting flange portion of a frame panel.
Figure 38:
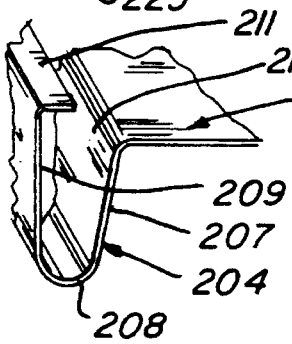
FIG. 38 is a perspective view of outturned connecting flange portion of a skin panel.

If a roof truss is to be added this is fastened as shown in FIGS. 15–17. This dual roof-dual side wall panel building section 180 is raised by the lift apparatus by actuating the hydraulic cylinders 98 to an upright position as is shown in FIGS. 21 and 24. FIG. 33 shows that the female connecting flange portion 58 of the roof skin panel 51R having the male connecting flange portion 68 of building section 180 will drop down over the male connecting flange portion 59 of the adjoining skin panel 51R that is in place in an upright position and then the joint is seamed so that an already existing building section would be fastened to the next building section. In practice the formed building section is clamped to the existing section and when the lifting apparatus is removed and the clamps are released so the flange of the next building section will drop into place to be seamed. While building section 180 shown is composed of two skin panels and two frame panels it is understood that only one skin panel and one frame panel can be assembled and raised as above described for two skin and two frame panels. It is also understood that other multiples could be assembled and raised into position according to the present invention.

Figure 3:
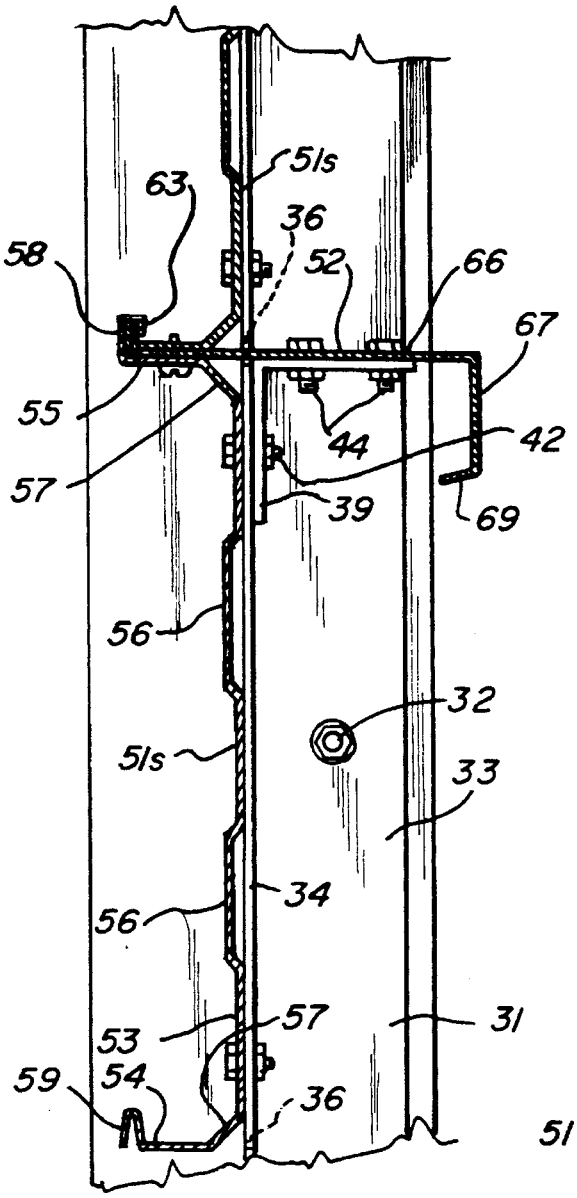
FIG. 3 is a sectional view taken along line 3—3 of FIG. 2.

Once in the upright position the side wall frame panel sections are anchored or fastened to the base using base clips 38 and bolt and nut fasteners as shown in FIGS. 3–5. The framing jig and lifting apparatus 90 is moved along the opposed rails and locked into the next position using the indexing mechanisms 106 and the holes 36 in the upright leg of the base member 31. The base members 31 have extensions 31*a* along each side to allow apparatus 90 to travel past the foundation. These extensions 31*a* are cue off flush with the end walls after the assembly of the side walls of the building.

Referring now to FIGS. 34–38 there is shown another form of skin panel 201 and another form of frame panel 202. Each skin panel 201 in general has the same features of construction as the above described skin panels 51S and 51R. Each skin panel 201 differs in connecting flange construction by having an inturned connecting flange portion 204 at the extremity of one side wall and an outturned connecting flange portion 205 at the extremity of the other side wall. Each inturned connecting flange portion 204 is generally U-shaped and arranged transverse to the associated side wall. More specifically has an inturned leg 207, a curved bend 208, and an outturned leg 209 with a terminal section 211. The inturned connecting flange portion 204 has a flange opening 212 that faces out relative to the associated side wall.

The outturned connecting flange portion 205 is generally U-shaped and is arranged transverse to the associated side wall. The flange portion 205 has an outturned leg 214, a curved bend 215 and an inturned leg 216 providing a flange opening 218 that faces in relative to the associated side wall.

Each frame panel 202 has an intermediate web 221, a transverse connecting flange portion 222 and a transverse wall 223 extending from opposite ends of the web and generally transverse thereto. The transverse connecting flange portion 222 has a leg 224, curved bend 225 and return leg 226 with a flange opening 227.

Figure 35:
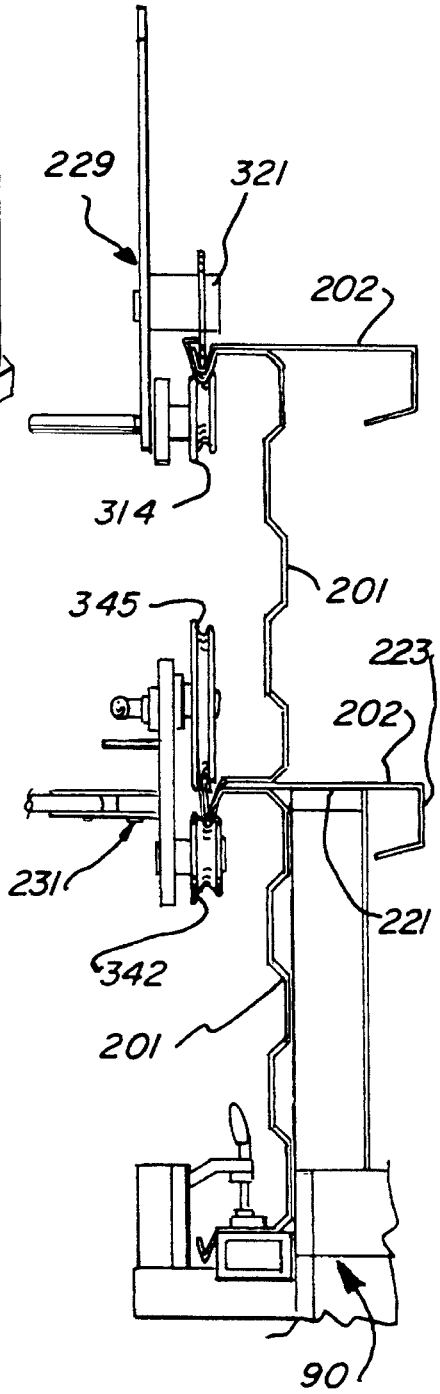
FIG. 35 is a sectional view taken along line 35—35 of FIG. 34.
Figure 39:
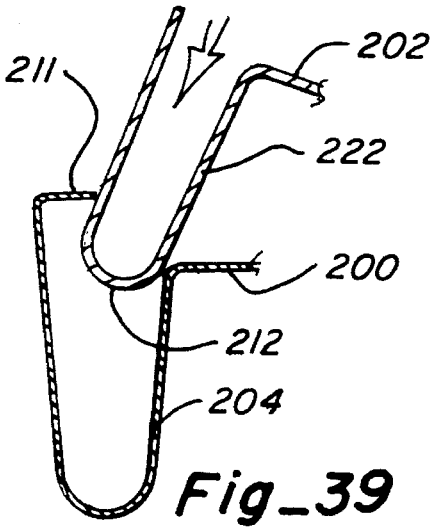
FIG. 39 shows partial insertion of the transverse connecting flange portion of frame panel into the inturned connecting flange portion of a skin panel.
Figure 42:
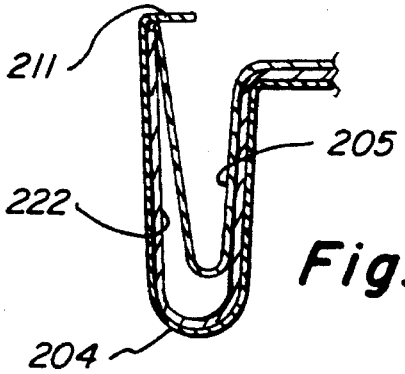
FIG. 42 shows full insertion of the outturned connecting flange portion of FIG. 41.
Figure 43:
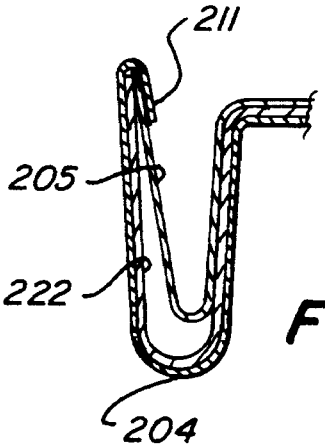
FIG. 43 shows a terminal section of the assembly of FIG. 42 turned to a connecting position.
Figure 40:
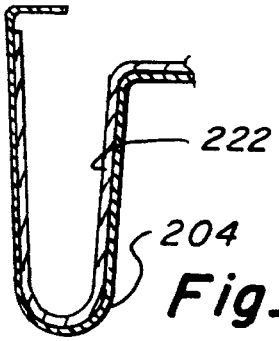
FIG. 40 shows the transverse connecting flange portion of the frame panel fully inserted into the flange portion of the skin panel.
Figure 41:
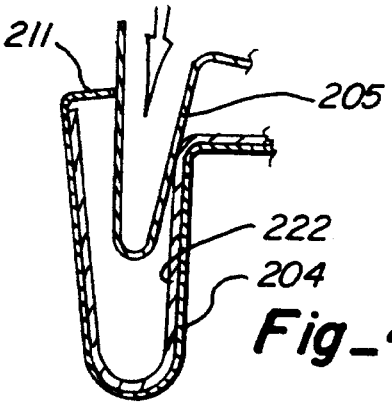
FIG. 41 shows partial insertion for the outturned connecting flange portion of a skin panel into the assembly of FIG. 40.

For connecting two skin panels 201 and a frame panel 202 together in a down position on the jig and lifting apparatus 90, as shown the inturned connecting flange portion 204 of a first skin panel has the flange opening 212 facing up as seen in FIGS. 35 and 39. The transverse connecting flange portion 222 of the frame panel 202 is positioned inside the facing up inturned flange portion 204. This is done either by slidably telescoping one within the other by inserting at the end or may be done by inserting the transverse flange portion partially inside the inturned flange portion via the flange opening 212 (FIG. 39). A panel connecting apparatus 229 is then used to connect the panels together. The panel connecting apparatus 229 has opposed rollers 321 and 313 or 314 that push or press one connecting flange portion into the other connecting flange portion. The connecting apparatus 221 is then used to push or press the outturned flange connecting portion 205 of a second skin panel inside the transverse connecting flange portion 222 via opening 227 as seen in FIG. 41 as the apparatus 229 is moved along the panels. Another panel connecting apparatus 231 having opposed rollers 345 and 342, 343 operates so that as the connecting apparatus 231 is moved along the panels it turns the terminal section 211 down back into the opening in the outturned flange connecting portion 205 to form a continuous seam as seen in FIGS. 42 and 43. Before the panel assembly is raised a second frame panel 202 may be connected to a second skin panel 201 using the panel connecting apparatus 229. The panel assembly of the two skin panels and two frame panels shown in the drawing may then be raised from a down horizontal position to an up or raised position. It is understood that only a single skin panel and frame panel may be raised instead of two as shown and described.

Figure 44:
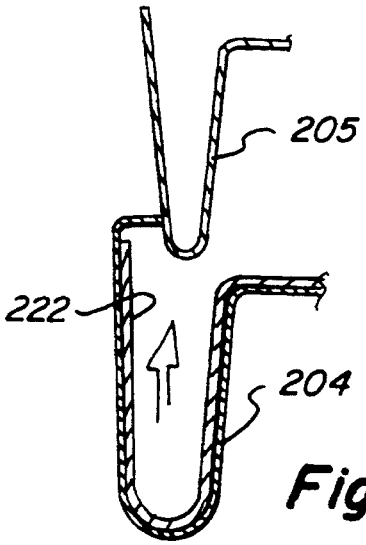
FIG. 44 shows positions of three panels when one is in place and two others are moved so the connecting flange portions fit over one the connecting flange portions in place.
Figure 45:
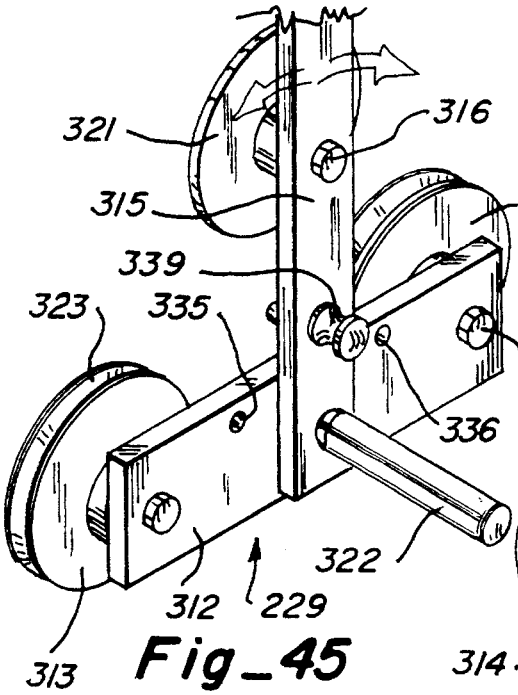
FIG. 45 is a rear perspective view of panel connecting apparatus embodying features of the present invention.
Figure 46:
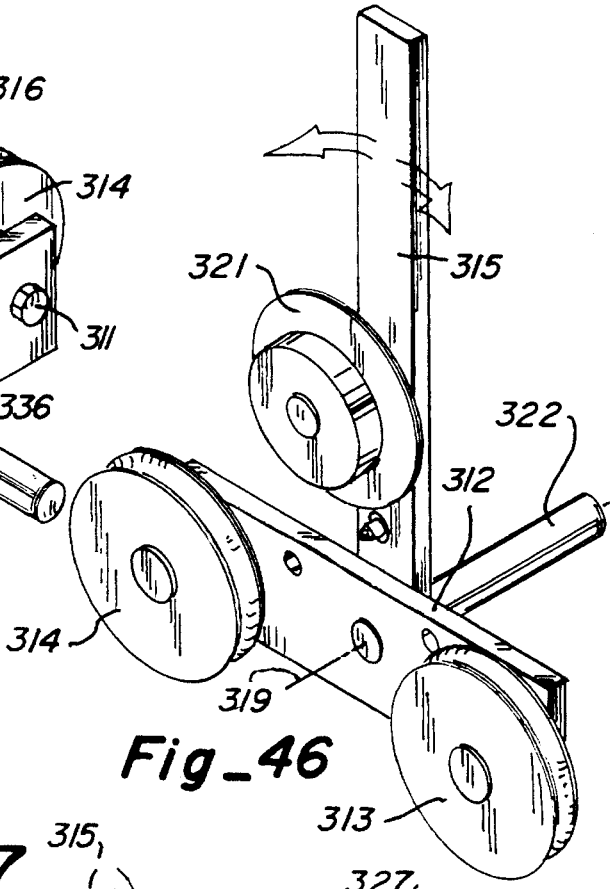
FIG. 46 is a front perspective view of the panel connecting apparatus shown in FIG. 45.
Figure 47:
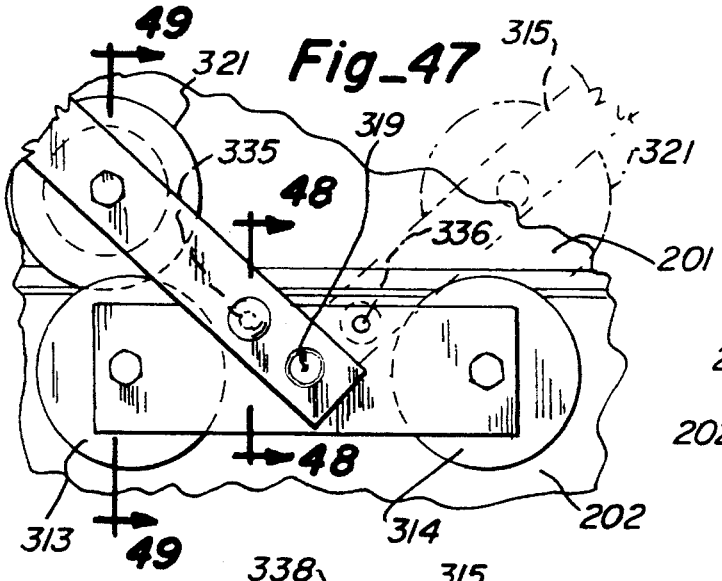
FIG. 47 is a fragmentary front elevational view of the apparatus shown in FIGS. 45 and 46 but with two panels shown being connected by the apparatus.
Figure 48:
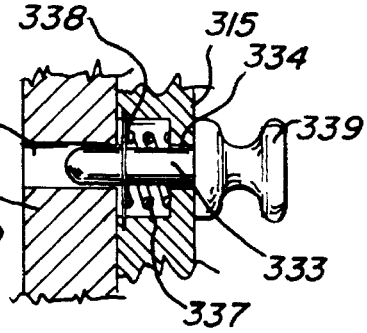
FIG. 48 is a sectional view taken along lines 48—48 of FIG. 47.

Referring now to FIG. 44, in a procedure for connecting the assembled panel assembly to a skin panel that is already in an up position, the outturned connecting flange portion 205 faces toward the panel assembly to be added. The panel assembly is rotated up by the lift mechanism 90 and the already assembled transverse connecting flange portion 222 and the inturned connecting flange portion 204 are placed over the outturned flange portion 205 of the skin panel 201 in place. The panel connecting apparatus 229 is then used to bring the panel flange portions together and panel connecting apparatus 231 is used to turn the terminal section 211 back and over the end portions of the other two panels to connect the three panels together.

The panel connecting apparatus 229 shown in FIGS. 45 to 49 has a base plate 312 with two spaced tracking or support rollers 313 and 314 mounted for free rotation on an associated shaft 311 that extends through a hole in base plate 312. A pivot plate 15 is pivotally connected to the base plate 312 by a pivot shaft 316 midway between rollers 13 and 14 that extends through a hole in base plate to rotate about an axis 319. An engagement roller 321 is mounted on the pivot plate. The engagement roller 321 is movable on the pivot plate toward and away from the first support roller 313 or the second support roller 314. A handle 322 is mounted to the pivot plate 315 forming a rearward extension of pivot shaft 311 to enable the operator to grip the apparatus for movement along the panels being connected.

Figure 49:
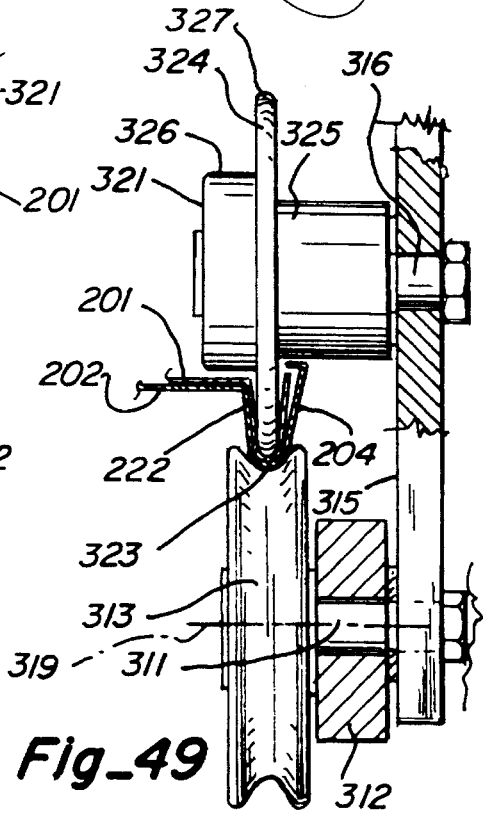
FIG. 49 is a sectional view taken along line 49—49 of FIG. 47.
Figure 50:
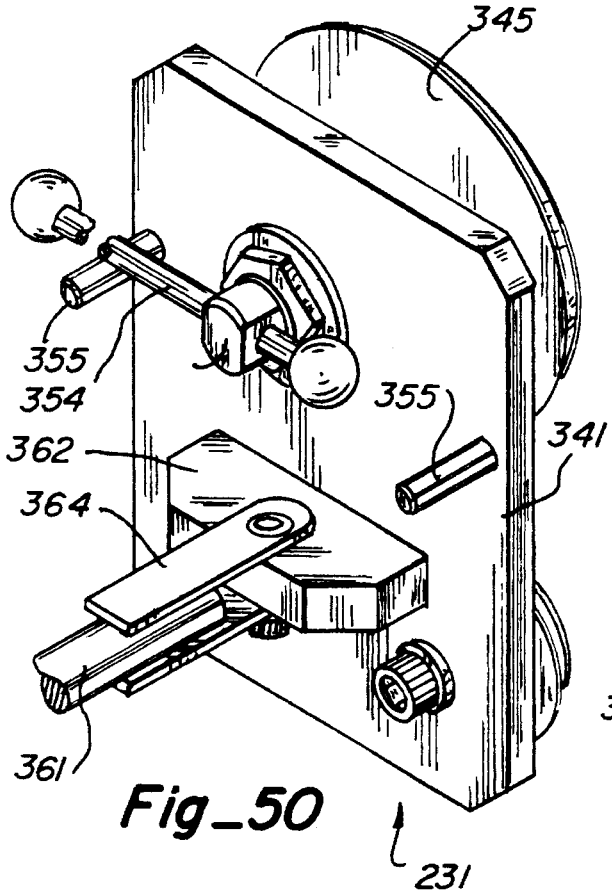
FIG. 50 is a rear perspective view of another panel connecting apparatus embodying features of the present invention.
Figure 51:
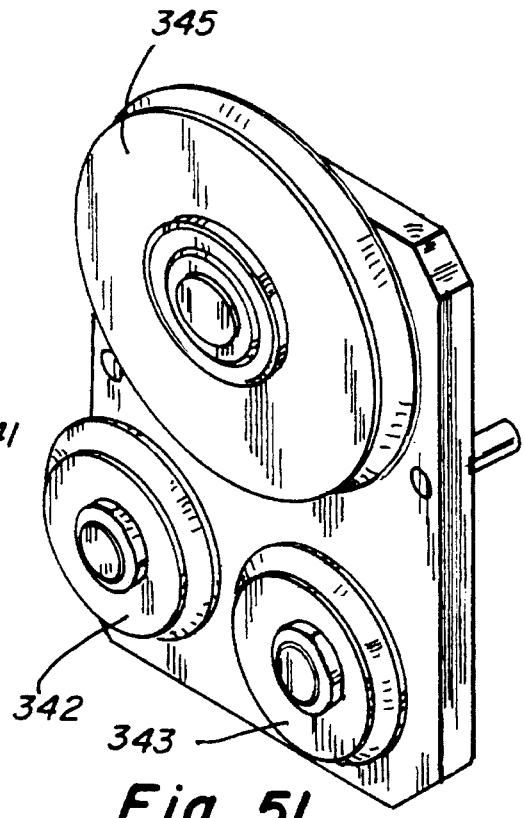
FIG. 51 is a front perspective view of the apparatus shown in FIG. 50.
Figure 52:
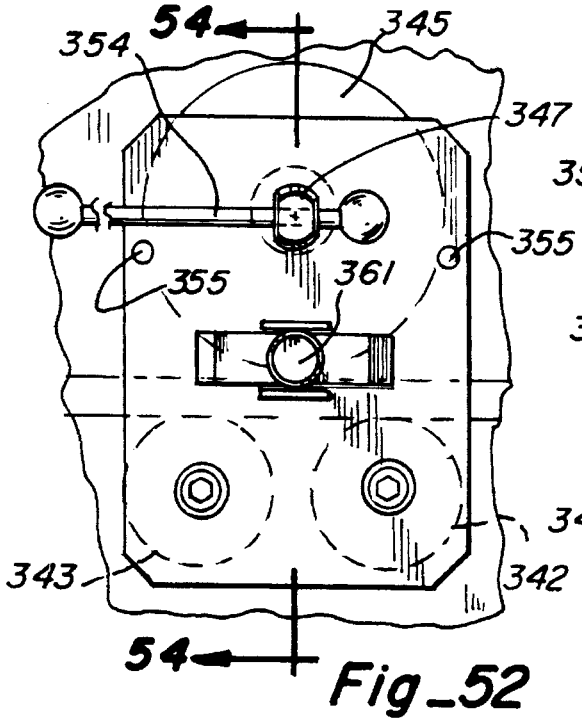
FIG. 52 is a fragmentary rear elevational view of the apparatus shown in FIGS. 50 and 51 with the handle and hem roller in the retracted position.
Figure 55:
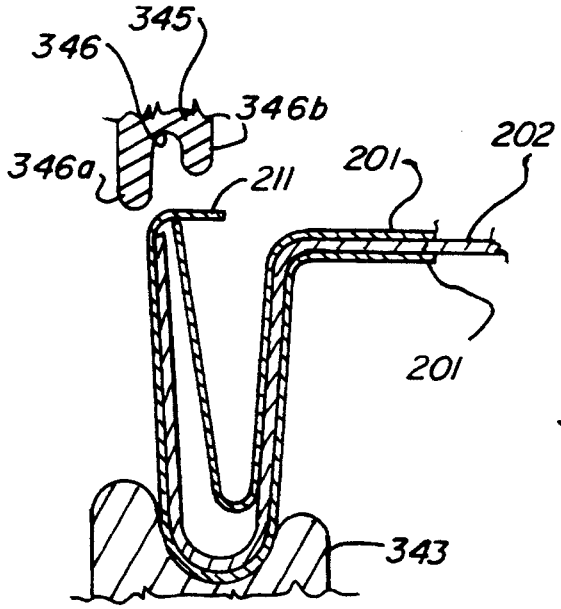
FIG. 55 is a sectional view taken along line 55—55 of FIG. 53.

The support rollers 313 and 314 have a U-shaped peripheral groove 323 that will engage and run along the outside surface of the bend of the connecting flange portion of the panel. The engagement roller 321 has an enlarged roller section 324 of greater diameter than smaller diameter hub sections 325 and 326 on either side of enlarged section 324. This enlarged roller section 324 has a rounded or radiused peripheral edge 327 and is sized in relation to the U-shaped transverse connecting flange portion 222 on the frame panel 202 to move the connecting flange portion 222 into a nesting relation in the U-shaped inturned connecting flange portion 204 of skin panel 201 via a flange opening 212 as the apparatus is moved along the two panels as seen in FIG. 49. The connecting apparatus 229 is also used to insert the outturned connecting flange portion 205 of another skin panel 201 into the connecting flange portions of the first-mentioned panels via associated flange openings as shown in FIG. 55 with roller section 327 operating in a similar manner.

A locking mechanism is provided to lock the pivot plate 315 to the base plate 312. This mechanism is carried by the pivot plate and is a pin 333 that extends through a hole 334 in the pivot plate 315 and inserts into a hole 335 in the base plate 312 in a first operating position. A hole 336 is also provided on the plate to enable the pin to lock the pivot plate in a second operating position as shown in dashed lines.

A spring 337 in an enlarged section of the hole 336 in the pivot plate 315 and surrounding the pin 333 is biased against a flange 338 on the pin 333 to urge the pin in the hole 335 or 336 on the base plate. A knob 339 on the pin is gripped by the user to pull the pin 333 from the hole to release the pivot arm for pivotal movement about axis 319.

The pivot plate 315 and roller 321 are shown in a first operating position with pin 333 in hole 335. The pivot plate 315 extends or tilts at an angle of about 45 degrees from a right angle position to the base plate 12. When the pin is retracted the pivot plate 315 and roller 321 can be moved to the transverse or right angle relative to base plate 312 which is the retracted position during which the connecting apparatus 229 can be placed on the connecting portions of the panel. The pivot plate 315 and roller 321 can then be pivoted to the second operating position shown in dashed lines with pin 333 inserted into hole 336 to lock the pivot plate for operation. This enables the apparatus to be moved in either direction along the panels and readily removed by releasing the pin and moving the pivot plate to the intermediate retracted position shown in FIGS. 45 and 46.

Panel connecting apparatus 231 shown in FIGS. 50–57 includes a support plate 341 on which there is mounted two spaced tracking or guide rollers 342 and 343 and a hem roller 345 opposite and between guide rollers 342 and 343 and between which the connecting flange portions of two panels to be connected are positioned. Each guide roller is mounted on a shaft 344. Each guide roller is mounted on a roller bearing 377 carried on shaft 344 with a through bore 378. A threaded bolt 379 extends through an elongated hole 381 in the support plate, through the through bore 378 of the shaft and has a nut 382 threaded on the end of bolt 379 opposite an allen head 383. A set screw 384 extends up through the end of the plate and bears against the bolt to enable vertical adjustment of the roller 342 relative to the plate 341. This allows slight adjustments of positions of the roller 342 relative to hem roller 345 for different types and thicknesses of metals.

The hem roller 345 has a U-shaped peripheral groove 346 bounded on each side by rounded peripheral portions **346*a* and 346*b* of different diameters with the groove 346 serving to fold the terminal section 211 of the panel down and in. The larger diameter portion 346*a* serves as a back stop for the panel connecting flange portion to position the panel in place. The hem roller 345 is mounted for free rotation on a shaft 347 that extends through a hole in plate 341 and is supported to rotate about an axis 348. The shaft 347 has a flange 349 that butts against one side of the plate 341 and a threaded portion 351 with a spring washer 352 and lock nut 353 to secure the shaft to the plate 341. This assembly on shaft 347 provides resistance to movement for the shaft 347 as the shaft is rotated. A transverse handle 354 extends through a hole in the rear end of the shaft 347 which permits manual rotation of the shaft about its axis 348. A stop pin 355 affixed to the plate on each side of the shaft 347 limits the extent of the rotational movement of the handle 354**.

Figure 53:
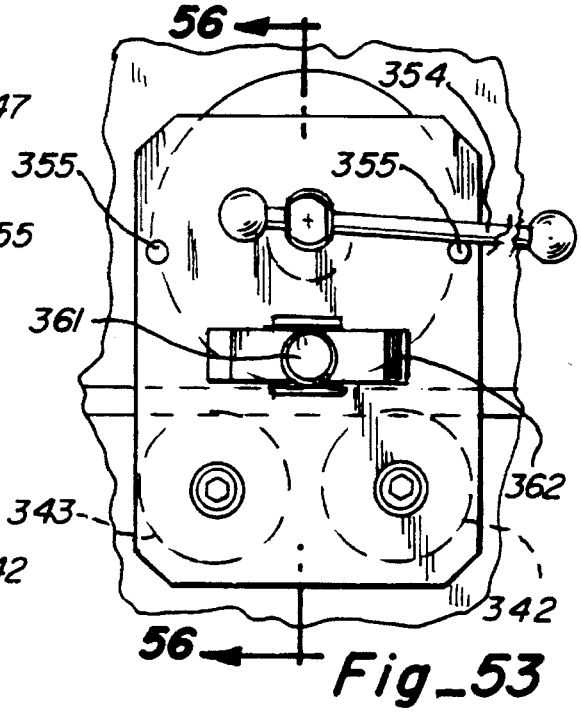
FIG. 53 is a fragmentary rear elevational view of the apparatus with the handle and hem roller in an extended operating position.
Figure 54:
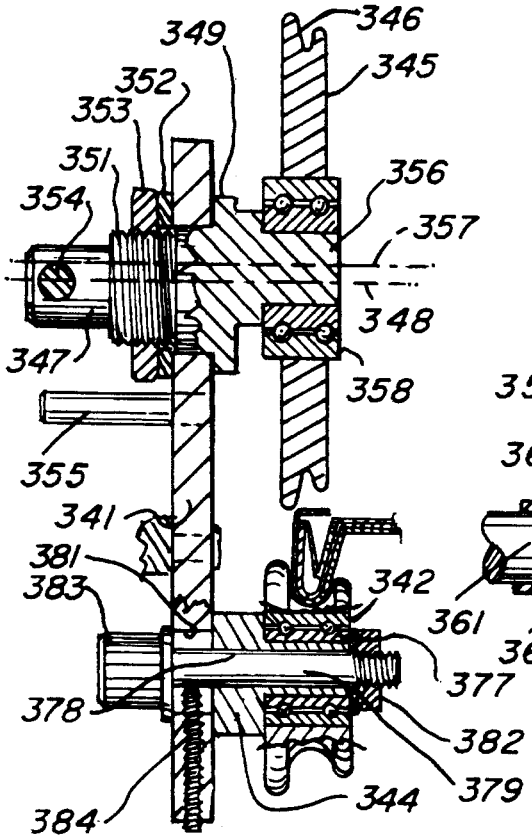
FIG. 54 is a sectional view taken along line 54—54 of FIG. 52.
Figure 56:
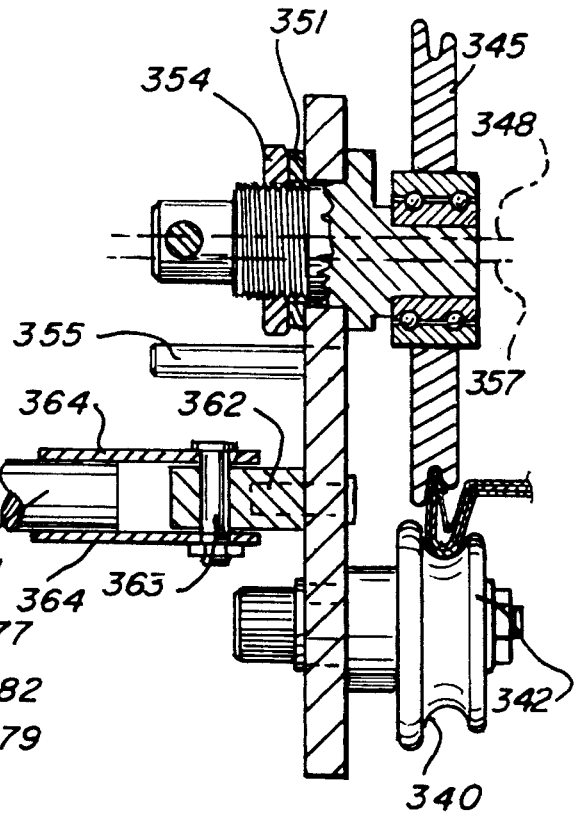
FIG. 56 is an enlarged view of the hem and one guide roller in the retracted position and the associated flange connecting portions of the three panels being connected.
Figure 57:
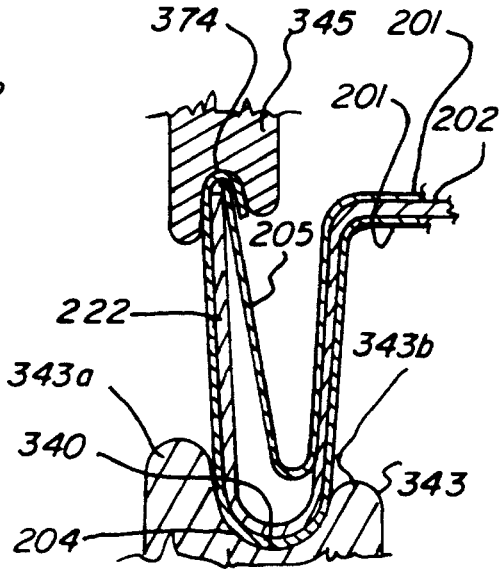

The shaft 347 has an offset or eccentric section 356 with a center along axis 357 that is spaced a selected distance from axis 348. A roller bearing 358 mounts on the eccentric section 356 with the hem roller 345 being mounted on the bearing 358. In this way when the shaft 347 is rotated about axis 348 the hem roller 345 will move toward the guide rollers 342 and 343 to an operating position and back to a retracted position. When the handle 354 is moved to an over-center position about 10 degrees past a horizontal position as seen in FIG. 53 the hem roller is in the operating position to turn down the panel terminal section 211 to join the panels as is seen in FIG. 57. The over-center position shown is a locking position for the handle and shaft so the hem roller will not retract during the hemming operation. The reverse retracted position for the handle against the opposite pin 355 is also an over-center locking position.

A handle 361 is pivotally mounted to the support plate 341 by means of a flange 362 on the plate, a pivot bolt 363 and two plates 364 that fasten to the handle, fit over the flange and are pivotally connected by the bolt 363. This allows the handle to swing from side to side. The handle 361 enables the user to manually move the panel connecting apparatus 231 along the panels.

As seen in FIG. 57 the outer surface of the curved bend of an inturned connecting flange portion 204 of a skin panel 201 is disposed in the groove 340 of the guide rollers 342 and 343. The transverse connecting flange portion 222 of a frame panel 202 and outturned connecting flange portion 205 of a second seam panel 201 nest in flange portion 204 and the terminal section 211 is folded back and against the end portions of flange portions 222 and 205 to form a hem that connects, seams or locks the three panels together along a continuous seam.

The hem roller 345 is made larger than the guide rollers 342 and 343. In the embodiment shown the hem roller has an O.D. of 5.5 inches and the guide rollers have an O.D. of 2.75 inches or a ratio of two to one. A range of ratio of diameters of hem roller to each guide roller of 1.5 to 5 to one would be suitable. A larger diameter hem roller contacts the flange sooner, minimizes bending resistance rolls it through a longer arc thereby generating a gentler bending process. Further, less force is required to push the apparatus along the panel. While a single smaller guide roller directly opposite the hem roller would be usable, two smaller spaced rollers provide stability for the apparatus. Additional smaller guide rollers may also be used.

Although the present invention has been described with a certain degree of particularity, it is understood that the present disclosure has been made by way of example and that changes in details of structure may be made without departing from the spirit thereof.

What is claimed is:

1. In a building, the combination comprising:

a first skin panel having a female connecting flange portion at one side, a frame panel extending generally transverse to said first skin panel, said frame panel having an intermediate web portion, a male flange portion at one side of said web portion extending transverse to said web portion, said male flange portion being disposed in said female connecting flange portion, said frame panel having a double flange portion at the other side of said web portion including a side flange section extending transverse to said web portion and an end flange section extending transverse to said side flange section and along said web section and terminating in a free end, and a second skin panel having a male connecting flange portion at one side disposed in said female connecting flange portion with said female connecting flange portion having an end flange turned in and under said male connecting flange portions to form a continuous seam that secures said first and second skin panels and said frame panels together as an integral dual skin-single frame panel section, said frame panel being load bearing to serve as a self-supporting frame that also supports the load of said first and second skin panels.

2. In a building as set forth in claim 1 wherein each skin panel is generally channel-shaped having an intermediate base and two sidewalls extending away from opposite sides of said base and generally transverse thereto, two laterally spaced longitudinal ribs in said base and angled corner sections at the corners of said base and side walls, said female connecting flange portions of said side walls being extensions of associated of said side walls.

3. In a building as set forth in claim 1 wherein said male connecting flange portion of said second skin panel has an inturned flange section.

4. In a building as set forth in claim 1 wherein said male connecting flange portion of said skin panel has an inturned flange section and an outturned lateral flange section looped back at a bend and over said inturned flange section.

5. In a building as set forth in claim 1 wherein each of said skin panels are sheet metal and each has a thickness in the range of about 0.02 to 0.04 inches.

6. In a building as set forth in claim 1 wherein said frame panel is sheet metal having a thickness in the range of about 0.03 inches to 0.07 inches.

7. In a building, the combination comprising:

a foundation, a base means secured to said foundation and extending along said foundation, a plurality of base clips fastened to said base means at selected distances from one another along said base means, a pair of oppositely disposed side walls supported on said base means and foundation, and a pitched roof supported on and fastened to said side walls, each of said side walls and said roof including a first skin panel having a female connecting flange portion at one side, a frame panel extending generally transverse to said first skin panel, said frame panel having an intermediate web portion, a male flange portion at one side of said web portion extending transverse to said web portion, said male flange portion being disposed in said female connecting flange portion, said frame panel having a double flange portion at the other side of said web portion including a side flange section extending transverse to said web portion and an end flange section extending transverse to said side flange section and along said web section and terminating in a free end, a second skin panel having a male connecting flange portion at one side disposed in said female connecting flange portion with said female connecting flange portion having an end flange turned in and under said male connecting flange portions to form a continuous seam that secures said first and second skin panels and frame panels together as an integral dual skin-single frame panel section, said frame panel being load bearing to serve as a self-supporting frame that also supports the load of said first and second skin panels, the bottom end portions of said frame panels of said side walls being fastened to said base means by said base clips.

8. In a building as set forth in claim 7 wherein said base means includes a pair of parallel spaced base members that extend in straight lines along opposite sides of said foundation, each said base member has a right angle profile with a base leg and an upright leg, said base leg having holes for receiving anchor bolts for anchoring the base means to said foundation, said upright leg having a plurality of holes located a selected distance apart for establishing the position of said frame panels of said side walls on said foundation.

9. In a building as set forth in claim 8 wherein said base clip has a right angle profile with an upper leg and a base leg.

10. In a building as set forth in claim 9 wherein said base clip is disposed on its side with said base leg fastened to the upright leg of said base means and said upper leg is fastened to a frame panel of a side wall.

11. In a building as set forth in claim 9 wherein said base clip is disposed upright with said base leg fastened to the base leg of the base means and said upper leg fastened to a frame panel of a side wall.

12. In a building as set forth in claim 7 including a pair of end walls supported at opposite ends of said foundation, said end walls having two skin panels and a frame panel seamed together as integral dual skin-single frame panel section.

13. In a building as set forth in claim 7 further including:

gusset means fastened to the upper end of each side wall frame panel and to an adjacent of a roof frame panel.

14. In a building as set forth in claim 13 wherein said gusset means is a plate fastened by a plurality of hollow rivet-type fasteners extending through holes in said side wall and roof frame panels, said rivet having at least one rolled flange of a size larger than said holes.

15. In a building as set forth in claim 14 wherein said fastener has an internal diameter at least four times the thickness of the side wall and roof frame panels through which said fastener extends.

16. In a building as set forth in claim 13 including a roof truss fastened to said pitched roof and said gusset means to strengthen said pitched roof, said fastening being provided by a hollow rivet-type fastener extending through holes in the parts being fastened.

17. In a building as set forth in claim 16 wherein said roof truss includes a horizontal member fastened at opposite ends to said gusset means at opposite inside corners and diagonal strut members connected between said roof frame panels and said horizontal member.

18. In a building as set forth in claim 16 wherein said roof truss includes a pair of crossing diagonal members fastened at opposite ends to said gusset means at opposite inside corners and each fastened to the roof frame panel at an opposite side of the pitched roof apex and vertical strut members fastened between said roof frame panels and said diagonal members.

19. In a building as set forth in claim 7 wherein each side wall skin panel has a bend adjacent the upper end to provide an angled end section that extends under and is complimentary in shape with and interfits with an adjacent roof skin panel to form a corner joint, said roof skin panel extending beyond said interfitting side wall panel to provide an overhanging roof.

20. In a building as set forth in claim 7 wherein said pitched roof skin and frame panels each have spaced bends intermediate the ends to form an apex section and two end sections at a selected angle to the vertical.

21. In a straight wall building, the combination comprising:

a foundation, a base means secured to said foundation and extending along said foundation, said base means having a right angle profile with a base leg and an upright leg, said base leg having holes for receiving anchor bolts for anchoring the base means to said foundation, said upright leg having a plurality of holes located a selected distance apart for establishing a side wall frame panel position on said foundation, a plurality of base clips fastened to said base means at selected distances from one another along said base means, said base clips having a right angle profile with an upper leg and a base leg, a pair of oppositely disposed straight side walls supported on said base means and foundation, and a pitched roof supported on and fastened to said side walls, each of said side walls and said roof including a first skin panel having a female connecting flange portion at one side, a frame panel extending transverse to said first skin panels, said frame panel having an intermediate web portion, a male flange portion at one side of said web portion extending transverse to said web portion, said male flange portion being disposed in said female connecting flange portion, said frame panel having a double flange portion at the other side of said web portion including a side flange section extending transverse to said web portion and an end flange section extending transverse to said side flange section and along said web section and terminating in a free end, a second skin panel having a male connecting flange portion at one side disposed in said female connecting flange portion with said female connecting flange portion having an end flange turned in and under said male connecting flange portions to form a continuous seam that secures said first and second skin panels and frame panels together as an integral dual skin-single frame panel section, said frame panel being load bearing to serve as a self-supporting frame that also supports the load of said first and second skin panels, said base clips fastening the bottom end portions of said frame panels of said side walls to said base means, and gusset means fastened to the upper end of each side wall frame panel and to an adjacent of a roof frame panel.

22. In a panel assembly, the combination comprising:

a first panel having an inturned connecting flange portion with a terminal section, a second panel having a transverse connecting flange portion adjacent said inturned connecting flange portion, said second panel having an intermediate web portion, a transverse connecting flange portion at one side of said web portion extending transverse to said web portion, said second panel having a double flange portion at the other side of said web portion including a side flange section extending transverse to said web portion and an end flange section extending transverse to said side flange section and along said web portion and terminating in a free end, a third panel having an outturned connecting flange portion adjacent said inturned and transverse connecting flange portions, said terminal section being turned back over end portions of said inturned and transverse connecting flange portions to connect said first, second and third panels together at a continuous seam, said frame panel being load bearing to serve as a self-supporting frame that also supports the load of said first and second panels.

23. In a panel assembly as set forth in claim 22 wherein said first and third panels are skin panels and said second panel is a frame panel arranged in a building.

24. In a panel assembly as set forth in claim 22 wherein each said connecting flange portion is generally U-shaped.

25. A method of connecting panels including a first panel having an inturned connecting flange portion with a terminal section, a second panel having a transverse connecting flange portion, said second panel having an intermediate web portion, a transverse connecting flange portion at one side of said web portion extending transverse to said web portion, said second panel having a double flange portion at the other side of said web portion including a side flange section extending transverse to said web portion and an end flange section extending transverse to said side flange section and along said web portion and terminating in a free end, and a third panel having an outturned connecting flange portion comprising the steps of:

positioning said transverse connecting flange portion inside said inturned flange connecting portion, and positioning said outturned connecting flange portion inside said transverse and inturned connecting flange portions, and turning said terminal section back and over end portions of said transverse and inturned flange connecting portions to connect said first, second and third panels together at a continuous seam, said frame panel being load bearing to serve as a self-supporting frame that also supports the load of said first and second panels.

26. A method of connecting panels including connecting a first panel having an inturned connecting flange portion and a terminal section with a a second panel having a transverse connecting flange portion adjacent said inturned connecting flange portion, said second panel having an intermediate web portion, a transverse connecting flange portion at one side of said web portion extending transverse to said web potion, said second panel having a double flange portion at the other side of said web portion including a side flange section extending transverse to said web portion and an end flange section extending transverse to said side flange section and along said web portion and terminating in a free end, moving said inturned connecting and transverse connecting flange portions to a position adjacent a third panel having an outturned connecting flange portion, and turning said terminal section back and over end portions of said inturned and transverse connecting flange portions to connect said panels together at a continuous seam, said frame panel being load bearing to serve as a self-supporting frame that also supports the load of said first and second panels.

* * * * *